US010891895B2

(12) United States Patent
Miyata et al.

(10) Patent No.: US 10,891,895 B2
(45) Date of Patent: Jan. 12, 2021

(54) LIGHT EMITTING DEVICE, DISPLAY DEVICE, AND LED DISPLAY DEVICE

(71) Applicant: SHARP KABUSHIKI KAISHA, Sakai (JP)

(72) Inventors: Hidekazu Miyata, Sakai (JP); Noriaki Yamaguchi, Sakai (JP)

(73) Assignee: SHARP KABUSHIKI KAISHA, Osaka (JP)

( * ) Notice: Subject to any disclaimer, the term of this patent is extended or adjusted under 35 U.S.C. 154(b) by 0 days.

(21) Appl. No.: 16/449,217

(22) Filed: Jun. 21, 2019

(65) Prior Publication Data

US 2020/0005710 A1 Jan. 2, 2020

Related U.S. Application Data

(60) Provisional application No. 62/690,668, filed on Jun. 27, 2018.

(51) Int. Cl.

| | |
|---|---|
| ***G09G 3/3233*** | (2016.01) |
| ***G09G 3/3258*** | (2016.01) |
| ***G09G 3/20*** | (2006.01) |

(52) U.S. Cl.

CPC ..... *G09G 3/3233* (2013.01); *G09G 3/2022* (2013.01); *G09G 3/3258* (2013.01); *G09G 2300/0833* (2013.01); *G09G 2300/0842* (2013.01); *G09G 2330/021* (2013.01)

(58) Field of Classification Search

None

See application file for complete search history.

(56) References Cited

U.S. PATENT DOCUMENTS

| | | | | |
|---|---|---|---|---|
| 2002/0140659 | A1* | 10/2002 | Mikami | G09G 3/3258 345/90 |
| 2005/0212729 | A1 | 9/2005 | Chung | |
| 2006/0001613 | A1 | 1/2006 | Routley et al. | |
| 2009/0115703 | A1 | 5/2009 | Cok | |

FOREIGN PATENT DOCUMENTS

| | | | |
|---|---|---|---|
| JP | 2002-297097 | A | 10/2002 |
| JP | 2005-284254 | A | 10/2005 |
| JP | 2005-530203 | A | 10/2005 |
| JP | 2011-503645 | A | 1/2011 |

* cited by examiner

*Primary Examiner* — Nicholas J Lee

(74) *Attorney, Agent, or Firm* — ScienBiziP, P.C.

(57) ABSTRACT

A plurality of LED drive circuits are provided so as to correspond one-to-one with plurality of LED units arranged in matrix. In the LED drive circuit, a data voltage is written to a memory capacitor in a charge period that appears every one frame period, in the LED drive circuit, the reset control transistor is turned on and off more than once after a time point at which the charge period ends until a time point at which the next charge period starts, so that a lighting enable period in which a lighting period control operation is performed is provided more than once every one frame period.

10 Claims, 19 Drawing Sheets

LIGHT EMITTING DEVICE, DISPLAY DEVICE, AND LED DISPLAY DEVICE

CROSS REFERENCE TO RELATED APPLICATIONS

This application claims priority to U.S. Provisional Patent Application No. 62/690,668, entitled "LIGHT EMITTING DEVICE, DISPLAY DEVICE, AND LED DISPLAY DEVICE", filed on Jun. 27, 2018, the content of which is incorporated herein by reference.

BACKGROUND OF THE INVENTION

1. Field of the Invention

The disclosure herein relates to a light emitting device employing LEDs as light sources, a display device using the light emitting device for backlight, and an LED display device constituted by the light emitting device.

2. Description of Related Art

A transmissive type liquid crystal display device requires, in order to display images, backlight that emits light to a display unit (liquid crystal panel) from its back surface. Conventionally, as a light source of the backlight, a cold-cathode tube referred to as a CCFL has been widely used. However, in recent years, an LED (light-emitting diode) has become widely employed due to low power consumption and facilitation of brightness control.

Regarding the liquid crystal display device, in order to decrease power consumption, a technology called "local dimming" has been developed in which a screen is logically divided into a plurality of areas, and brightness (light emission intensity) of LED is controlled for each of the areas. According to the local dimming, the brightness of each of the LEDs is determined based on, for example, a maximum value, an average value, and the like of input gradation values of pixels included in a corresponding area. In this manner, each of the LEDs emits light with brightness depending on an input image for the corresponding area.

Further, in recent years, a technology called "HDR" that realizes an extremely wide dynamic range has been introduced more widely. While maximum brightness according to the conventional technology is 100 nits, maximum brightness according to the HDR standard is from 1000 nits to 10000 nits. A specification (standard) for a liquid crystal display device adapting to the HDR is also determined. Specifically, the liquid crystal display device adapting to the HDR is required to satisfy the following standard so that a contrast ratio at "20000:1" is achieved.

Maximum brightness: 1000 nits or higher

Black brightness: 0.05 nits or lower

In order to satisfy this standard, the local dimming described above is employed for the liquid crystal display device adapting to the HDR.

FIG. 11 is a schematic view of a direct backlight employing the local dimming. This backlight includes an LED driver substrate 910 and an LED substrate 920. The LED substrate 920 is logically divided into a plurality of areas, and one or more LEDs 922 are mounted as a light source on each of the areas. As schematically shown in FIG. 12, on the LED driver substrate 910 and the LED substrate 920, control signal lines for driving LEDs are provided for the respective areas. It should be noted that although FIG. 12 shows a variable resistor 912 as a device for controlling an amount of current for each of the areas and a switch 914 as a device for turning a current ON and OFF, it is sufficient to have only one of them according to a dimming control method to be employed. Further, a control device is not limited to the variable resistor 912 and the switch 914, and it is possible to perform control by replacing the variable resistor 912 and the switch 914 with transistors.

Now, a dimming control method for LEDs will be described. Examples of the dimming control method include an analog dimming control method for controlling brightness by changing a magnitude of currents flowing through the LEDs, and a PWM dimming control method for controlling brightness by changing lighting time of the LEDs. In brief, dimming control according to the analog dimming control method corresponds to changing a resistance value of the variable resistor 912 shown in FIG. 12, and dimming control according to the PWM dimming control method corresponds to varying ratio of time in an ON state and an OFF state of the switch 914 shown in FIG. 12. According to the analog dimming control method, as shown in FIG. 13, lighting time of the LEDs is assumed to be constant, and the brightness of the LEDs is controlled by changing the magnitude of currents flowing through the LEDs. According to the PWM dimming control method, as shown in FIG. 14, a magnitude of currents flowing through the LEDs is assumed to be constant, and the brightness of the LEDs is controlled by changing the lighting time of the LEDs.

Further, examples of an approach of the dimming control for backlight for the liquid crystal display device include an LD dimming control for controlling the LEDs so as to obtain brightness depending on an input image for each area and for each frame, and a maximum display brightness dimming control for controlling brightness of the LEDs depending on target brightness for an entire screen. Either of these two approaches may be employed in combination with the analog dimming control method or the PWM dimming control method. However, according to the analog dimming control method, as relationship between the current flowing through the LED and the brightness of the LED is non-linear, it is difficult to perform control to obtain brightness with desired accuracy. In addition, the analog dimming control method poses another problem that chromaticity may change depending on the current value. Therefore, in many cases in recent years, for either of the LD dimming control and the maximum display brightness dimming control, it is employed in combination with the PWM dimming control method with which the current value is constant.

In the meantime, in recent years, development of microscopic LEDs (such as LEDs called "mini LEDs" and "micro LEDs") as compared to the conventional LEDs has become more active. It is expected that a display region of a display device is divided into multiple areas by employing backlight that performs local dimming using such microscopic LEDs. In this regard, it is difficult to implement an approach of driving LEDs for each area using the configuration shown in FIG. 12 due to reasons such as an enormous number of lines being required. Therefore, it may be considered to have data lines be integrated for each column and to enable driving for each row. In other word, a use of matrix wiring may be considered.

As one example of a driving method using the matrix wiring, passive driving is known. Passive driving is performed in a state in which wirings are provided on a LED driver substrate 930 and a LED substrate 940 as shown schematically in FIG. 15. Similarly to the example in FIG. 12, it is sufficient to have one of a variable resistor 932 and a switch 934. As LEDs are driven row by row according to the configuration shown in FIG. 15, in passive driving, one frame period is divided into a plurality of sub-frame periods, and in each sub-frame period LEDs of a corresponding row are lit. In the case of the example in FIG. 15, one frame period is divided into four sub-frame periods T91-T94 as shown in FIG. 16, LEDs are lit row by row. While either of the PWM dimming control method and the analog dimming control method may be employed as a dimming control method for the LEDs, the PWM dimming control method is better suited in view of reduction of occurrence of variation in brightness and chromaticity. Further, in practice, a unit of driving LEDs in a case in which one frame period is divided into a plurality of sub-frame periods is not limited to one row. There are also cases in which LEDs are driven plural rows by plural rows, and in which LEDs are driven for each of areas, for example, divided into right and left.

According to passive driving, each LED is lit only in a corresponding sub-frame period in each frame period, and therefore a lighting period of each LED becomes short. For example, in a case in which each frame period is constituted by four sub-frame periods, in each frame period, the lighting period of each LED is one quarter of one frame period. Therefore, brightness becomes one quarter of a case in which LEDs emit light throughout one frame period. Accordingly, in order to obtain brightness as in the case in which LEDs emit light throughout one frame period, it is necessary to supply quadruple current to LEDs in a sub-frame period. Further, as data relating to driving of the LEDs is required to be controlled for each sub-frame period, data transmission from, devices such as a controller to a LED driver becomes more frequent. Considering the above circumstances, if division of a display region into multiple areas is promoted by employment of microscopic LEDs, a number of sub-frame periods that constitute one frame period significantly increases, which will make it difficult to drive LEDs.

As another example of a driving method using the matrix wiring, active matrix-type driving is known. Active matrix-type driving is employed for organic EL display devices, for example. FIG. 17 is a circuit diagram showing one example of a pixel circuit of the organic EL display device. The pixel circuit is provided for each of intersections between a plurality of data lines and a plurality of scanning lines which are arranged on a display unit. As shown in FIG. 17, the pixel circuit includes two transistors 950, 952, a capacitor 954, and an organic EL element 956. The transistor 950 serves as an input transistor for selecting a pixel, the transistor 952 serves as a current control transistor for controlling current supply to the organic EL element 956. In practice, in order to compensate variation in characteristics of the transistor 952, for example, the pixel circuit is also provided with components that are not shown in FIG. 17.

According to the pixel circuit shown in FIG. 17, when a potential of a scanning line becomes a potential indicating a select period, the transistor 950 is turned to the ON state, and the capacitor 954 is charged depending on a potential of a data line. Upon completion of the select period, the transistor 950 is turned to the OFF state, and the capacitor 954 holds an electric charge. Therefore, a charging potential is maintained until the next select period. A gate-source voltage Vgs of the transistor 952 is determined based on the electric charge held in the capacitor 954, and a current of a magnitude corresponding to the gate-source voltage Vgs flows through the transistor 952.

In order to ensure a sufficient length for a light emission period regarding the LEDs included in the backlight, it may be considered that the active matrix-type driving described above is applied to driving of the backlight. However, if a circuit of a configuration as shown in FIG. 17 is used, since the analog dimming control method is employed as the dimming control method for the LEDs, problems such as chromaticity change due to brightness of light emission and brightness variation among pixels due to variation in transistor characteristics may easily occur.

Thus, employing an approach combining the active matrix-type driving and the PWM dimming control method to drive LEDs included in the backlight may be considered. Similarly, employing the approach combining the active matrix-type driving and the PWM dimming control method to drive LEDs constituting the LED display device may also be considered. It should be noted that the LED display device is a display device having LEDs as display elements, and often used as a display for outdoor advertisement.

Regarding an organic EL display device, Japanese Laid-Open Patent Publication No. 2002-297097 discloses the invention in which brightness is adjusted by controlling the length of a lighting period of an organic EL element while employing active matrix-type driving.

According to the invention disclosed in Japanese Laid-Open Patent Publication No. 2002-297097, in order to suppress deterioration in image quality due to a magnitude of variation in characteristics of transistors for controlling current flowing through the organic EL element, a voltage comparator circuit (comparator) is provided in a pixel circuit in addition to the conventional components. The voltage comparator circuit compares a reference potential with a voltage (potential) accumulated, during a select period, in a capacitor (analog memory). At this time, by changing the reference potential inputted to the voltage comparator circuit over time, lit/unlit of the organic EL element is controlled depending on a magnitude of the voltage accumulated in the capacitor. As brightness is adjusted by controlling the length of the lighting period in this manner, it is possible to suppress an influence of the transistor characteristics to brightness.

FIG. 18 shows a diagram corresponding to FIG. 1 (the diagram showing a configuration of a pixel circuit according to a first practical example) of Japanese Laid-Open Patent Publication No. 2002-297097. FIG. 19 shows a chart corresponding to FIG. 2 (the chart showing a driving waveform according to the first practical example) of Japanese Laid-Open Patent Publication No. 2002-297097. As can be seen from the driving waveform shown in FIG. 19, a scanning voltage is increased during the select period, and the signal voltage during the select period is accumulated in the capacitor (see a waveform of a memory voltage in FIG. 19). Then, when the select period ends for all the pixels on the panel, a display period comes. Each organic EL element is lit during, out of the display period, a period of a length corresponding to the memory voltage accumulated in the capacitor. In the meantime, in a case in which a panel includes 1080 scanning lines, each frame period includes 1080 select periods. Therefore, the display period is a relatively short period.

FIG. 20 shows a diagram corresponding to FIG. 3 (the diagram showing a configuration of a pixel circuit according to a second practical example) of Japanese Laid-Open Patent Publication No. 2002-297097. FIG. 21 shows a chart corresponding to FIG. 4 (the diagram showing a driving waveform, according to the second practical example) of Japanese Laid-Open Patent Publication No. 2002-297097. A pixel circuit shown in FIG. 20 is provided with a time constant circuit constituted by a resistor and a capacitor. With this, it is possible to supply the voltage comparator circuit with a potential that changes over time depending on the memory voltage accumulated in the capacitor during the select period and a time constant, and thus an entire one frame period can be taken as a display period.

As described above, according to the invention disclosed in Japanese Laid-open Patent Publication No. 2002-297097, brightness of the organic EL element is controlled using the approach combining the active matrix-type driving and the PWM dimming control method, and therefore it is possible to suppress deterioration in image quality due to variation in transistor characteristics. An approach for adjusting brightness of a light source by controlling the length of a lighting period for the light source is also described in Japanese Translation of PCT International Application Publication No. 2005-530203, Japanese Translation of PCT International Application Publication No. 2011-503645, and Japanese Laid-Open Patent Publication No. 2005-284254.

However, applying the approach described in Japanese Laid-Open Patent Publication No. 2002-297097 to driving of the LEDs included in the backlight of the liquid crystal display device or the like and driving of the LEDs constituting the LED display device leads to problems stated below.

In general, with a liquid crystal display device, transmissivity of a pixel is on the order of several %. Therefore, the LEDs in the backlight are required to emit light with brightness by ten times to thirty times stronger than brightness displayed on a screen. However, according to the approach of the first practical example described in Japanese Laid-Open Patent Publication No. 2002-297097, the display period is relatively a short period of time as described above, and therefore it is not possible to obtain sufficient brightness. Further, all the LEDs emit light at once at a frame frequency of an image, and this causes flicker. The same problem occurs in the case of the LED display device, because the LED display device is required to obtain high brightness since it is often used outdoors.

According to the approach of the second practical example described in Japanese Laid-Open Patent Publication No. 2002-297097, since it is possible to take an entire one frame period as the display period, display with high brightness can be realized. However, as can be seen from FIG. 21, PWM dimming control is performed taking one frame period as a single cycle. In general, in the liquid crystal display device, flicker occurs unless light sources as the backlight are lit with a cycle that is ½ to ⅛ of a display cycle (a cycle at which an image is rewritten). Therefore, applying the approach of the second practical example to driving of the LEDs included in the backlight causes flicker. Further, in order to perform display with high brightness with the LED display device, it is desirable to make a lighting cycle of the LEDs to be a cycle that is shorter than ½ of the display cycle. In this regard, in the case in which the approach of the second practical example is applied to driving of the LEDs constituting the LED display device, when a frequency of image display is 60 Hz, a lighting frequency of the LEDs is 120 Hz or 240 Hz, for example. In a case in which the lighting frequency of the LEDs is 120 Hz, it is necessary to scan the scanning lines twice in one frame period. In a case in which the lighting frequency of the LEDs is 240 Hz, it is necessary to scan the scanning lines 4 times in one frame period. When the number of times of scanning the scanning lines increases in this manner, the length of the select period becomes short, and thus writing a desired voltage to the capacitor becomes difficult. In other words, it is difficult to cause the LEDs to emit light with desired brightness.

SUMMARY OF THE INVENTION

Thus, it is desired to provide a light emitting device capable of controlling a large number of LEDs independently without causing display defects such as variation in brightness and flicker.

(1) light emitting devices according to several embodiments of the present invention are each a light emitting device with LEDs as light sources, the light emitting device including:

a plurality of LED units arranged in matrix, each of the plurality of LED units including one or more LEDs;

a plurality of LED drive circuits configured to drive LEDs included in the plurality of LED units, the plurality of LED drive circuits corresponding to the plurality of LED units one on one;

a drive control circuit configured to control an operation of the plurality of LED drive circuits so that the LEDs included in the plurality of LED units are driven row by row, wherein each of the LED drive circuits includes:

a data voltage holding unit configured to hold a data voltage corresponding to target brightness of one or more LEDs included in a corresponding LED unit; and a lighting control unit configured to perform a lighting period control operation in which the one or more LEDs included in the corresponding LED unit is lit for a period of a length depending on the data voltage held in the data voltage holding unit, a signal line for supplying the data voltage to the plurality of LED drive circuits is provided for each column, regarding each of plurality of the LED drive circuits, a charge period of a predetermined length is provided every one frame period, and a plurality of lighting enable periods are provided during a period of a length corresponding to a length of one frame period from a time point at which the charge period ends, and an operation of each of the plurality of LED drive circuits is controlled by the drive control circuit, so that the data voltage corresponding to target brightness of the one or more LEDs included in the corresponding LED unit is written to the data voltage holding unit during the charge period, and so that the lighting period control operation by the lighting control unit is performed in the plurality of lighting enable periods.

According to the above configuration, one or more LEDs that constitute each of the LED units are driven by active matrix-type driving. Specifically, signal lines for supplying the data voltage to the LEDs are provided for respective columns, and the LEDs are driven row by row. Therefore, there is no possibility that the number of lines for driving the LEDs becomes enormous. Further, an entire part of one frame period is taken as the display period. Moreover, the LED drive circuit turns on the LEDs for a period of a length depending on the data voltage held in the data voltage holding unit. Specifically, brightness of the LEDs is controlled by the PWM dimming control. Therefore, it is possible to reduce occurrence of display defects such as variation in brightness. Furthermore, the lighting period control operation is performed more than once for each frame period. This makes the lighting cycle of the LEDs shorter, and prevents flicker from occurring. As described above, it is possible to realize a light emitting device capable of controlling a large number of LEDs independently without causing display defects such as variation in brightness and flicker.

(2) Moreover, light emitting devices according to several embodiments of the present invention are each a light emitting device including the configuration of above (1), wherein the lighting control unit includes:

a lighting control node;

a reset unit configured to control supply of a voltage corresponding to the data voltage held in the data voltage holding unit to the lighting control node;

a potential reduction unit configured to cause a potential at the lighting control node to decrease over time; and a drive current control unit configured to control supply of a drive current to a corresponding LED unit depending on a potential at the lighting control node.

(3) Moreover, light emitting devices according to several embodiments of the present invention are each a light emitting device including the configuration of above (2), wherein the potential reduction unit is an RC circuit including a lighting control capacitor and a lighting control resistor, the lighting control capacitor having one end connected to the lighting control node, the lighting control resistor having one end connected to the lighting control node and another end connected to another end of the lighting control capacitor.

(4) Moreover, light emitting devices according to several embodiments of the present invention are each a light emitting device including the configuration of above (2) or (3), wherein the drive current control unit includes:

a drive current control node;

a switch control resistor having one end connected to the lighting control node;

a switch control transistor which is a bipolar transistor having a base terminal connected to another end of the switch control resistor, a collector terminal connected to the drive current control node, and an emitter terminal that is grounded;

a pull-up resistor having one end to which a power-supply voltage is supplied, and another end connected to the drive current control node;

a driving transistor which is a field-effect transistor having a gate terminal connected to the drive current control node, and a drain terminal to which the power-supply voltage is supplied via a corresponding LED unit; and a voltage drop resistor having one end connected to a source terminal of the driving transistor, and another end that is grounded, (5) Moreover, light emitting devices according to several embodiments of the present invention are each a light emitting device including the configuration of above (2) or (3), wherein the drive current control unit includes:

a drive current control node;

a switch control transistor which is a thin film transistor having a gate terminal connected to the lighting control node, a drain terminal connected to the drive current control node, and a source terminal that is grounded;

a pull-up resistor having one end to which a power-supply voltage is supplied, and another end connected to the drive current control node;

a driving transistor which is a thin film transistor having a gate terminal connected to the drive current control node, and a drain terminal to which the power-supply voltage is supplied via a corresponding LED unit; and a voltage drop resistor having one end connected to a source terminal of the driving transistor, and another end that is grounded.

(6) Moreover, light emitting devices according to several embodiments of the present invention are each a light emitting device including the configuration of any one of above (1) to (5), wherein each of the plurality of LED drive circuits includes a buffer circuit configured to supply the lighting control unit with a potential corresponding to the data voltage held in the data voltage holding unit, (7) Moreover, light emitting devices according to several embodiments of the present invention are each a light emitting device including the configuration of above (1), wherein the light emitting device further includes:

data lines configured to transmit data signals outputted from, the drive control circuit, the data lines being arranged so as to correspond to respective columns;

scanning lines configured to transmit scanning signals outputted from, the drive control circuit, the scanning lines being arranged so as to correspond to respective rows; and reset lines configured to transmit reset signals outputted from the drive control circuit, the reset lines being arranged so as to correspond to respective rows, wherein the data voltage holding unit includes:

a data voltage holding node;

a selection control transistor including a first selection control transistor and a second selection control transistor, the first selection control transistor being a field-effect transistor having a gate terminal connected to a corresponding one of the scanning lines and a drain terminal connected to a corresponding one of the data lines, the second selection control transistor being a field-effect transistor having a gate terminal connected to the corresponding one of the scanning lines, a drain terminal connected to the data voltage holding node, and a source terminal connected to a source terminal of the first selection control transistor; and a memory capacitor having one end connected to the data voltage holding node, and another end that is grounded, each of the plurality of LED drive circuits includes a voltage follower circuit configured to supply the lighting control unit with a potential at the data voltage holding node, the lighting control unit includes:

a lighting control node;

a drive current control node;

a reset control transistor including a first reset control transistor and a second reset control transistor, the first reset control transistor being a field-effect transistor having a gate terminal connected to a corresponding one of the reset lines, a drain terminal connected to an output terminal of the voltage follower circuit, the second reset control transistor having a gate terminal connected to the corresponding one; of the reset lines, a drain terminal connected to the lighting control node, and a source terminal connected to a source terminal of the first reset control transistor;

an RC circuit including a lighting control capacitor and a lighting control resistor, the lighting control capacitor having one end connected to the lighting control node and another end that is grounded, the lighting control resistor having one end connected to the lighting control node and another end that is grounded;

a switch control resistor having one end connected to the lighting control node;

a switch control transistor which is a bipolar transistor having a base terminal connected to another end of the switch control resistor, a collector terminal connected to the drive current control node, and an emitter terminal that is grounded;

a pull-up resistor having one end to which a power-supply voltage is supplied, and another end connected to the drive current control node;

a driving transistor which is a field-effect transistor having a gate terminal connected to the drive current control node, and a drain terminal to which the power-supply voltage is supplied via a corresponding LED unit; and a voltage drop resistor having one end connected to a source terminal of the driving transistor, and another end that is grounded.

(8) Moreover, light emitting devices according to several embodiments of the present invention are each a light emitting device including the configuration of above (1), wherein the light emitting device further includes:

data lines configured to transmit data signals outputted from the drive control circuit, the data lines being arranged so as to correspond to respective columns;

scanning lines configured to transmit scanning signals outputted from the drive control circuit, the scanning lines being arranged so as to correspond to respective rows; and reset lines configured to transmit reset signals outputted from the drive control circuit, the reset lines being arranged so as to correspond to respective rows, wherein the data voltage holding unit includes:

a data voltage holding node;

a selection control transistor which is a thin film transistor having a gate terminal connected to a corresponding one of the scanning lines, a drain terminal connected to a corresponding one of the data lines, and a source terminal connected to the data voltage holding node; and a memory capacitor having one end connected to the data voltage holding node, and another end that is grounded, each of the plurality of LED drive circuits includes a source follower circuit constituted by a thin film transistor and a resistor, the source follower circuit being configured to supply the lighting control unit with a potential that is lower than a potential at the data voltage holding node by a voltage corresponding to a threshold voltage of the thin film transistor, the lighting control unit includes:

a lighting control node;

a drive current control node;

a reset control transistor which is a thin film, transistor having a gate terminal connected to a corresponding one of the reset lines, a drain terminal connected to an output terminal of the source follower circuit, and a source terminal connected to the lighting control node;

an RC circuit including a lighting control capacitor and a lighting control resistor, the lighting control capacitor having one end connected to the lighting control node and another end that is grounded, the lighting control resistor having one end connected to the lighting control node and another end that, is grounded;

a switch control transistor which is a thin film transistor having a gate terminal connected to the lighting control node, a drain terminal connected to the drive current control node, and a source terminal that is grounded;

a pull-up resistor having one end to which a power-supply voltage is supplied and another end connected to the drive current control node;

a driving transistor which is a thin film transistor having a gate terminal connected to the drive current control node, and a drain terminal to which the power-supply voltage is supplied via a corresponding LED unit; and a voltage drop resistor having one end connected to a source terminal of the driving transistor, and another end that is grounded.

(9) Moreover, display devices according to several embodiments of the present invention are each a display device including:

a display panel having a display unit for displaying an image; and the light emitting device including the configuration of any one of above (1) to (8), the light emitting device disposed on a back surface of the display panel so as to emit light to the display unit.

(10) Moreover, LED display devices according to several embodiments of the present invention are each a LED display device including:

the light emitting device including the configuration of any one of above (1) to (8), wherein the plurality of LED units are classified into K types depending on colors of emitted light, and each of picture elements is configured by LED units of the K types.

These and other objects, features, aspects, and effects of the present invention will be made more clear from, the following detailed description of the present invention with reference to the accompanying drawings.

DETAILED DESCRIPTION OF PREFERRED EMBODIMENTS

Hereinafter, embodiments will be described with reference to the drawings. It should be noted that targets of a first embodiment and a second embodiment are liquid crystal display devices, and targets of a third embodiment are LED display devices.

1. First Embodiment

<1.1 Overall Configuration>

Figure 2:
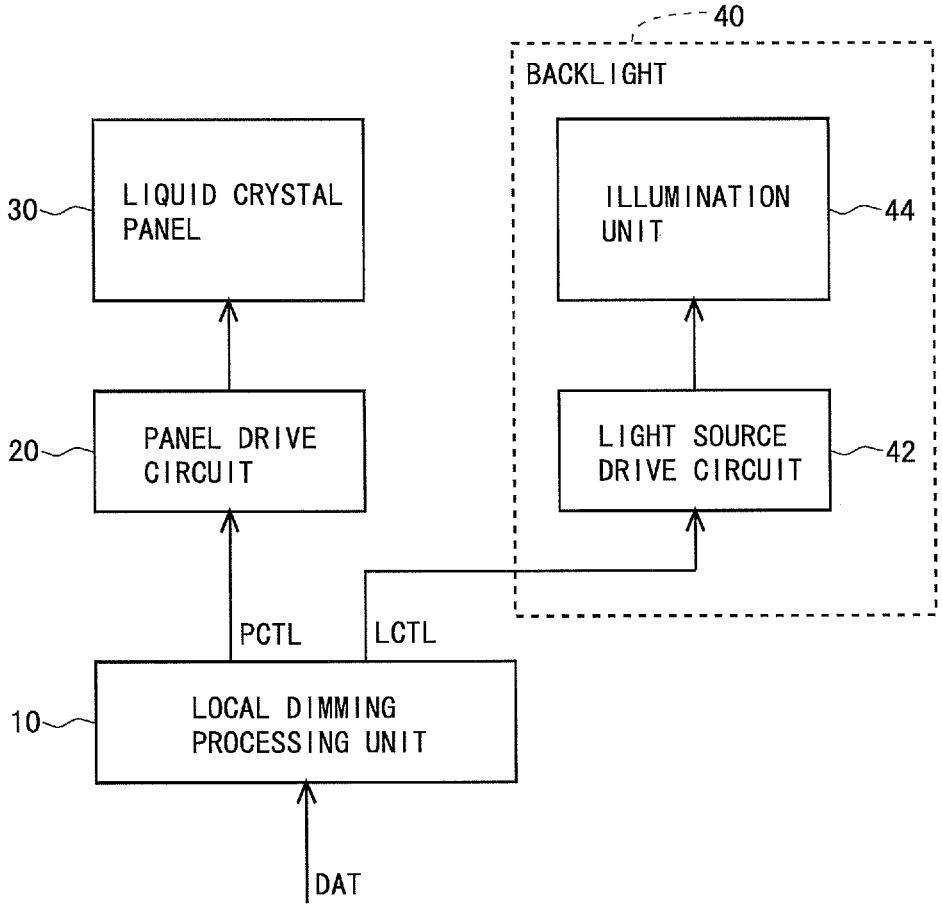
FIG. 2 is a block diagram showing an entire configuration of a liquid crystal display device according to the first embodiment.

FIG. 2 is a block diagram showing an entire configuration of a liquid crystal display device according to the first embodiment. The liquid crystal display device is constituted by a local dimming processing unit 10, a panel drive circuit 20, a liquid crystal panel 30, and a backlight (light emitting device) 40. The liquid crystal panel 30 is configured by two opposing glass substrates, and includes a display unit for displaying an image. The backlight 40 is provided on a back surface of the liquid crystal panel 30. The backlight 40 includes a light source drive circuit 42 and an illumination unit 44. The illumination unit 44 includes LED units (each of the LED units is constituted by one or more LEDs) and LED drive circuits which are mounted on a substrate (LED substrate) and will be described later. The local dimming processing unit 10, the panel drive circuit 20, and the light source drive circuit 42 are typically provided on different substrates.

Figure 3:
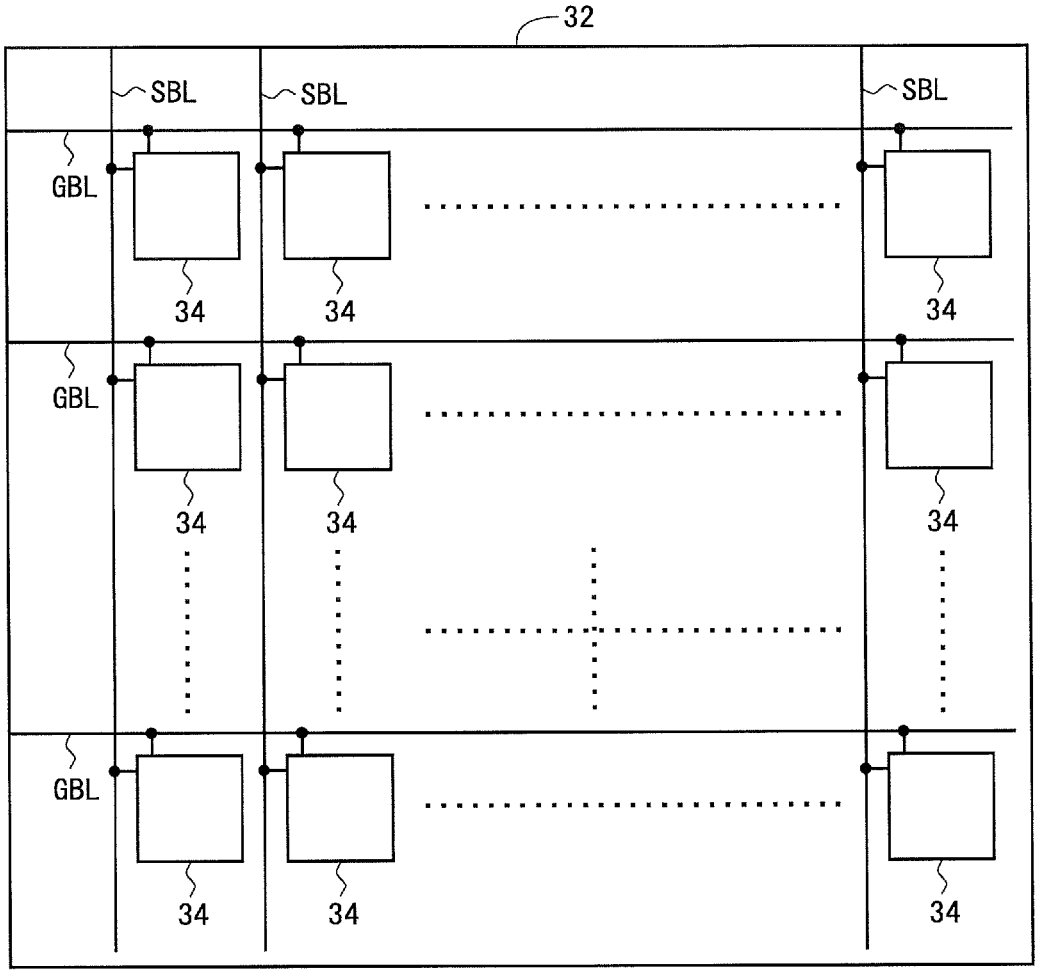
FIG. 3 is a diagram for illustrating a configuration of a display unit according to the first embodiment.

A display unit 32 in the liquid crystal panel 30 is, as shown in FIG. 3, provided with a plurality of gate bus lines GBL and a plurality of source bus lines SBL. A pixel unit 34 is provided corresponding to each of intersections between the plurality of gate bus lines GBL and the plurality of source bus lines SBL. Specifically, the display unit 32 includes a plurality of pixel units 34. The plurality of pixel units 34 are arranged in matrix to constitute a pixel matrix. Each of the pixel units 34 includes a pixel capacitance.

An operation of the components shown in FIG. 2 will be described. The local dimming processing unit 10 receives image data DAT transmitted from outside, and outputs a panel control signal PCTL for controlling an operation of the panel drive circuit 20 and a brightness control signal LCTL for controlling an operation of the light source drive circuit 42, so that the local dimming (processing for controlling brightness of LEDs for each area) is performed. Here, the panel control signal PCTL and the brightness control signal LCTL are constituted by a plurality of control signals.

The panel drive circuit 20 drives the liquid crystal panel 30 based on the panel control signal PCTL transmitted from the local dimming processing unit 10. Specifically, the panel drive circuit 20 is constituted by a gate driver for driving the gate bus lines GBL and a source driver for driving the source bus lines SBL. By the gate driver driving the gate bus lines GBL, and the source driver driving the source bus lines SBL, a voltage corresponding to a target display image is written to a pixel capacitance in each of the pixel units 34.

The light source drive circuit 42 controls an operation of the LED drive circuit described below, based on the brightness control signal LCTL transmitted from the local dimming processing unit 10, so that LEDs within the illumination unit 44 emit light with desired brightness. Here, the light source drive circuit 42 realizes a drive control circuit.

The illumination unit 44 includes the LED units and the LED drive circuits as described above, and LEDs within the LED units emit light with desired brightness by the light source drive circuit 42 controlling the operation of the LED drive circuits. In this manner, the illumination, unit 44 emits light to the display unit 32 from its back surface.

As described above, by the illumination, unit 44 within the backlight 40 emitting light to the display unit 32 from its back surface in a state in which a voltage corresponding to a target display image is written to the pixel capacitance in each of the pixel units 34 provided for the display unit 32 in the liquid crystal panel 30, a desired image is displayed on the display unit 32.

<1.2 Backlight>

<1.2.1 Schematic Configuration>

Figure 4:
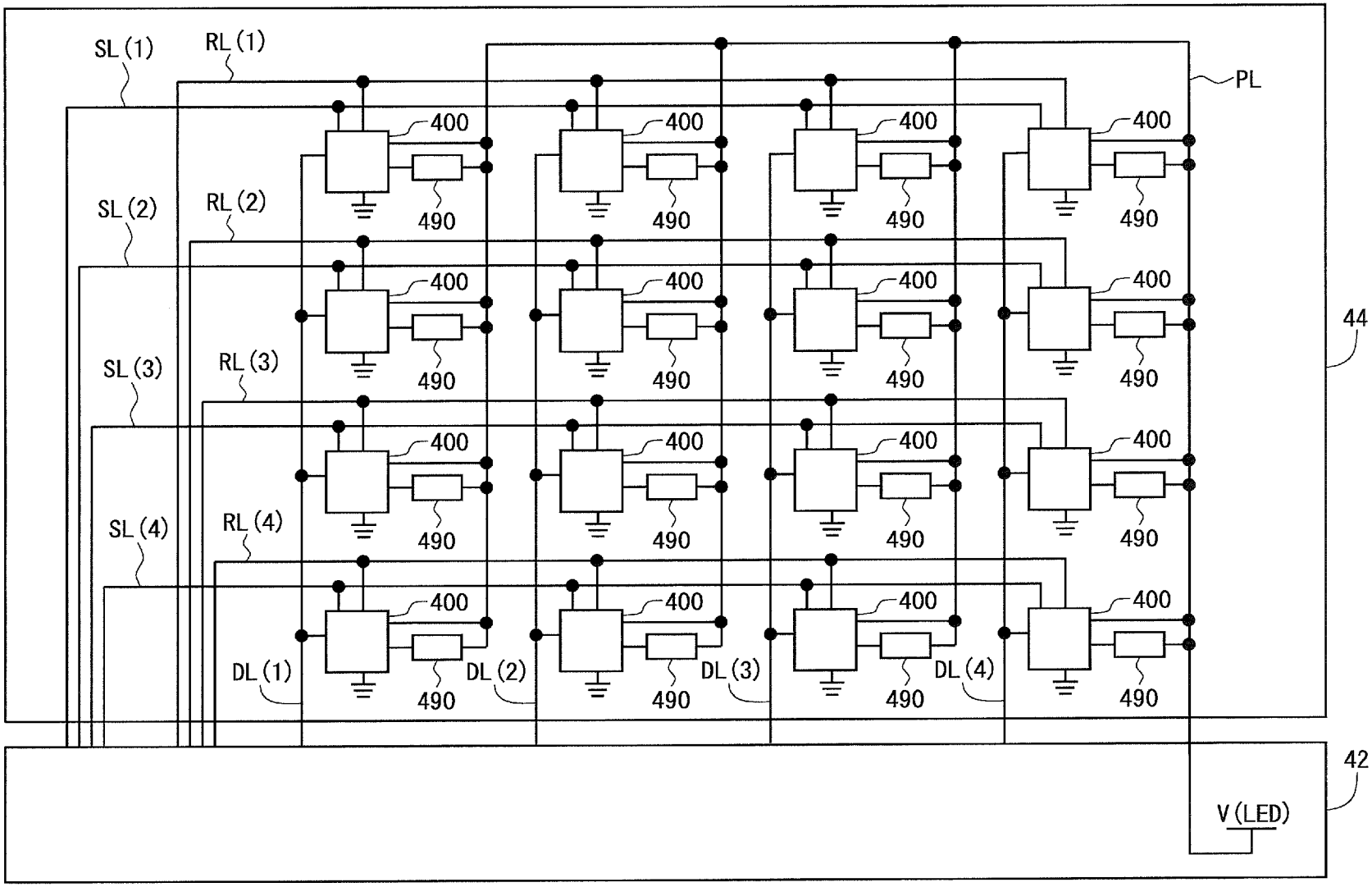
FIG. 4 is a block diagram for illustrating a schematic: configuration of a backlight according to the first embodiment.

FIG. 4 is a block diagram for illustrating a schematic configuration of the backlight 40. As described above, the backlight 40 includes the light source drive circuit 42 and the illumination unit 44. In this embodiment, it is assumed that a substrate (LED substrate) that constitutes the illumination unit is logically divided into 16 areas (4 vertical×4 horizontal). However, the possible number of areas may be 1000 or more (for example, 1152 (24×48)). Here, the LED substrate is constituted by a PCB, for example.

The illumination unit 44 includes LED units 490 each constituted by one or more LEDs and LED drive circuits 400 each driving LEDs included in each of the LED units 490. The 16 LED units 490 and the 16 LED drive circuits 400 are provided (16 is the number of the areas). Further, a power line PL, scanning lines SL provided one-to-one for respective rows, reset lines RL provided one-to-one for respective rows, and data lines DL provided one-to-one for respective columns are disposed on the LED substrate. The power line PL supplies a power-supply voltage, the scanning lines SL(1)-SL(4) transmit scanning signals outputted from the light source drive circuit 42, the reset lines RL(1)-RL(4) transmit reset signals outputted from the light source drive circuit 42, and the data lines DL(1)-DL (4) transmit data signals outputted from the light source drive circuit 42. In the following description, the scanning signals are also represented by a reference sign SL, the reset signals are also represented by a reference sign RL, and the data signals are also represented by a reference sign DL.

In the meantime, it is desirable that a surface on a side of the liquid crystal panel 30 out of surfaces that constitute the LED substrate is provided with only the LED units 490, and a surface on an opposite side is provided with the LED drive circuits 400. This is because the surface on the side of the liquid crystal panel 30 out of the surfaces that constitute the LED substrate forms a surface reflecting light emitted from the LEDs. Further, the LED substrate is multi-layered, and the power line PL, the scanning lines SL, the reset lines RL, and the data lines DL are provided for each layer.

The light source drive circuit 42 controls operations of the 16 LED drive circuits 400 so that the LEDs included in the 16 LED units 490 are driven row by row. Here, in FIG. 4, the power-supply voltage supplied to the power line; PL is represented by a reference sign V(LED).

<1.2.2 Configuration of LED Drive Circuit>

Figure 1:
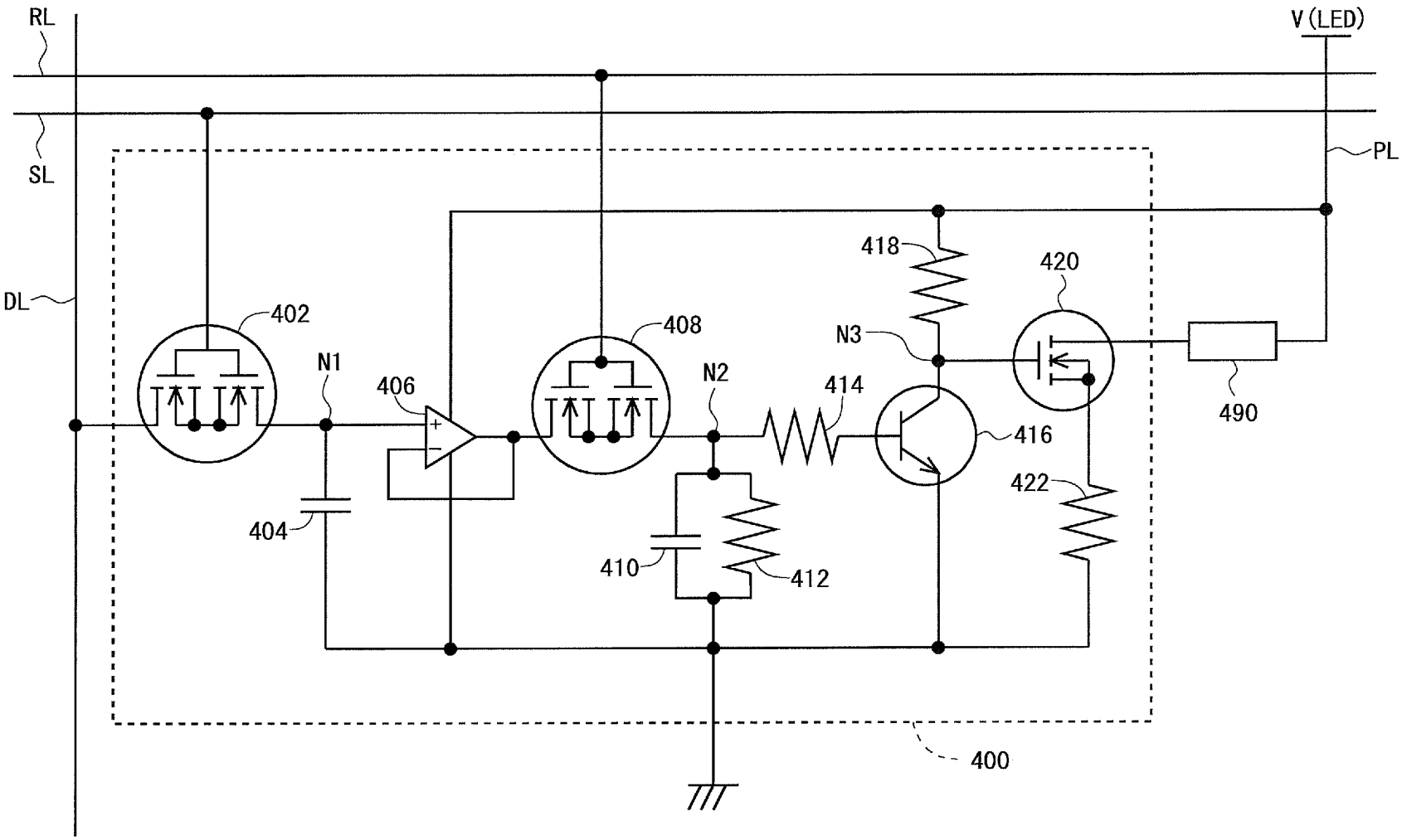
FIG. 1 is a circuit diagram showing a detailed configuration of a LED drive circuit according to a first embodiment.

FIG. 1 is a circuit diagram showing a detailed configuration of the LED drive circuit 400 according to this embodiment. As shown in FIG. 1, the LED drive circuit 400 is configured by a selection control transistor: 402 constituted by two field-effect transistors (FETs), a memory capacitor 404 which is a capacitor for holding a data voltage (a voltage of a data signal DL), a voltage follower circuit 406, a reset control transistor 408 constituted by two field-effect transistors, a capacitor (hereinafter referred to as a "lighting control capacitor") 410 and a resistor (hereinafter referred to as a "lighting control resistor") 412 constituting an RC circuit, a resistor (hereinafter referred to as a "switch control resistor") 414, a switch control transistor 416 which is a bipolar transistor, a pull-up resistor 418, a driving transistor 420 which is a field-effect transistor, and a resistor (hereinafter referred to as a "voltage drop resistor") 422. As can be seen from FIG. 1, the LED unit 490 is disposed between the power line PL and a drain terminal of the driving transistor 420.

Hereinafter, a relationship of connection between the components will be described. Here, a node connected to the selection control transistor 402, the memory capacitor 404, and the voltage follower circuit 406 is referred to as a "data voltage holding node", a node connected to the reset control transistor 408, the lighting control capacitor 410, the lighting control resistor 412, and the switch control resistor 414 is referred to as a "lighting control node", and a node connected to the switch control transistor 416, the pull-up resistor 418, and the driving transistor 420 is referred to as a "drive current control node". The data voltage holding node is represented by a reference sign N1, the lighting control node is represented by a reference sign N2, and the drive current control node is represented by a reference sign N3.

As described above, the selection control transistor 402 is constituted by two field-effect transistors. Here, one of the two field-effect transistors is referred to as a "first selection control transistor" and the other is referred to as a "second selection control transistor". Regarding the first selection control transistor, its gate terminal is connected to the scanning line SL, its drain terminal is connected to the data line DL, and its source terminal is connected to a source terminal of the second selection control transistor. Regarding the second selection control transistor, its gate terminal is connected to the scanning line SL, its drain terminal is connected to the data voltage holding node N1, and its source terminal is connected to the source terminal of the first selection control transistor.

Figure 5:
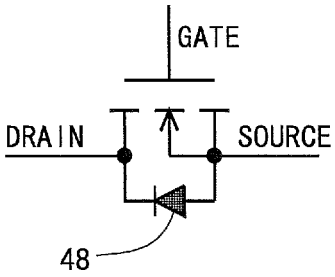
FIG. 5 is a diagram for explaining a reason why a selection control transistor is constituted by two field-effect transistors according to the first embodiment.

Here, the selection control transistor 402 is constituted by the two field-effect transistors because, due to a presence of a parasitic diode 48 between the source and the drain of the field-effect transistor as shown in FIG. 5, it is necessary to prevent the current from flowing from the source to the drain when the field-effect transistor is in the OFF state. The reason why the reset control transistor 408 is constituted by the two field-effect transistors is the same.

Regarding the memory capacitor 404, one end is connected to the data voltage holding node N1 and the other end is grounded. Regarding an operational amplifier that constitutes the voltage follower circuit 406, a non-inverting input terminal is connected to the data voltage holding node N1, an inverting input terminal is connected to an output terminal and the drain terminal of the first reset control transistor described below, and the output terminal is connected to the inverting input terminal and the drain terminal of the first reset control transistor described below.

As described above, the reset control transistor 408 is constituted by two field-effect transistors. Here, one of the two field-effect transistors is referred to as a "first reset control transistor" and the other is referred to as a "second reset control transistor". Regarding the first reset control transistor, its gate terminal is connected to the reset line RL, its drain terminal is connected to the output terminal of the operational amplifier that constitutes the voltage follower circuit 406, and its source terminal is connected to a source terminal of the second reset control transistor. Regarding the second reset control transistor, its gate terminal is connected to the reset line RL, its drain terminal is connected to the lighting control node N2, and its source terminal is connected to the source terminal of the first reset control transistor. Regarding the lighting control capacitor 410, one end is connected to the lighting control node N2 and the other end is grounded. Regarding the lighting control resistor 412, one end is connected to the lighting control node N2 and the other end is grounded.

Regarding the switch control resistor 414, one end is connected to the lighting control node N2 and the other is connected to a base terminal of the switch control transistor 416. Regarding the switch control transistor 416, the base terminal is connected to the other end of the switch control resistor 414, its collector terminal is connected to the drive current control node N3, and its emitter terminal is grounded. Regarding the pull-up resistor 418, one end is connected to the power line PL, and the other end is connected to the drive current control node N3. Regarding the driving transistor 420, its gate terminal is connected to the drive current control node N3, its drain terminal is connected to the LED unit 490, and its source terminal is connected to one end of the voltage drop resistor 422. Regarding the voltage drop resistor 422, the one end is connected to the source terminal of the driving transistor 420 and the other end is grounded.

It should be noted that while the field-effect transistors that configure the selection control transistor 402 and the reset control transistor 408 are of an n-channel type in this embodiment, it is possible to employ p-channel type field-effect transistors. In this case, the selection control transistor 402 is in the ON state when a potential of the scanning signal SL is at a low level, and the reset control transistor 408 is in the ON state when a potential of the reset signal RL is at a low level. Further, an emitter follower circuit using a bipolar transistor may be employed in place of the voltage follower circuit 406. However, in this case, it is necessary to supply the data line DL with the data signal DL considering that voltage drop by a threshold voltage between the base and the emitter may occur. Moreover, the switch control transistor 416 may employ a field-effect transistor, in place of the bipolar transistor.

In this embodiment, the selection control transistor 402, the data voltage holding node N1, and the memory capacitor 404 realize a data voltage holding unit. The reset control transistor 408, the lighting control node N2, the lighting control capacitor 410, the lighting control resistor 412, the switch control resistor 414, the switch control transistor 416, the drive current control node N3, the pull-up resistor 418, the driving transistor 420, and the voltage drop resistor 422 realize a lighting control unit. The reset control transistor 408 realizes a reset unit. The RC circuit constituted by the lighting control capacitor 410 and the lighting control resistor 412 realize a potential reduction unit. The switch control resistor 414, the switch control transistor 416, the drive current control node N3, the pull-up resistor 418, the driving transistor 420, and the voltage drop resistor 422 realize a drive current control unit.

<1.2.3 Operation>

Figure 6:
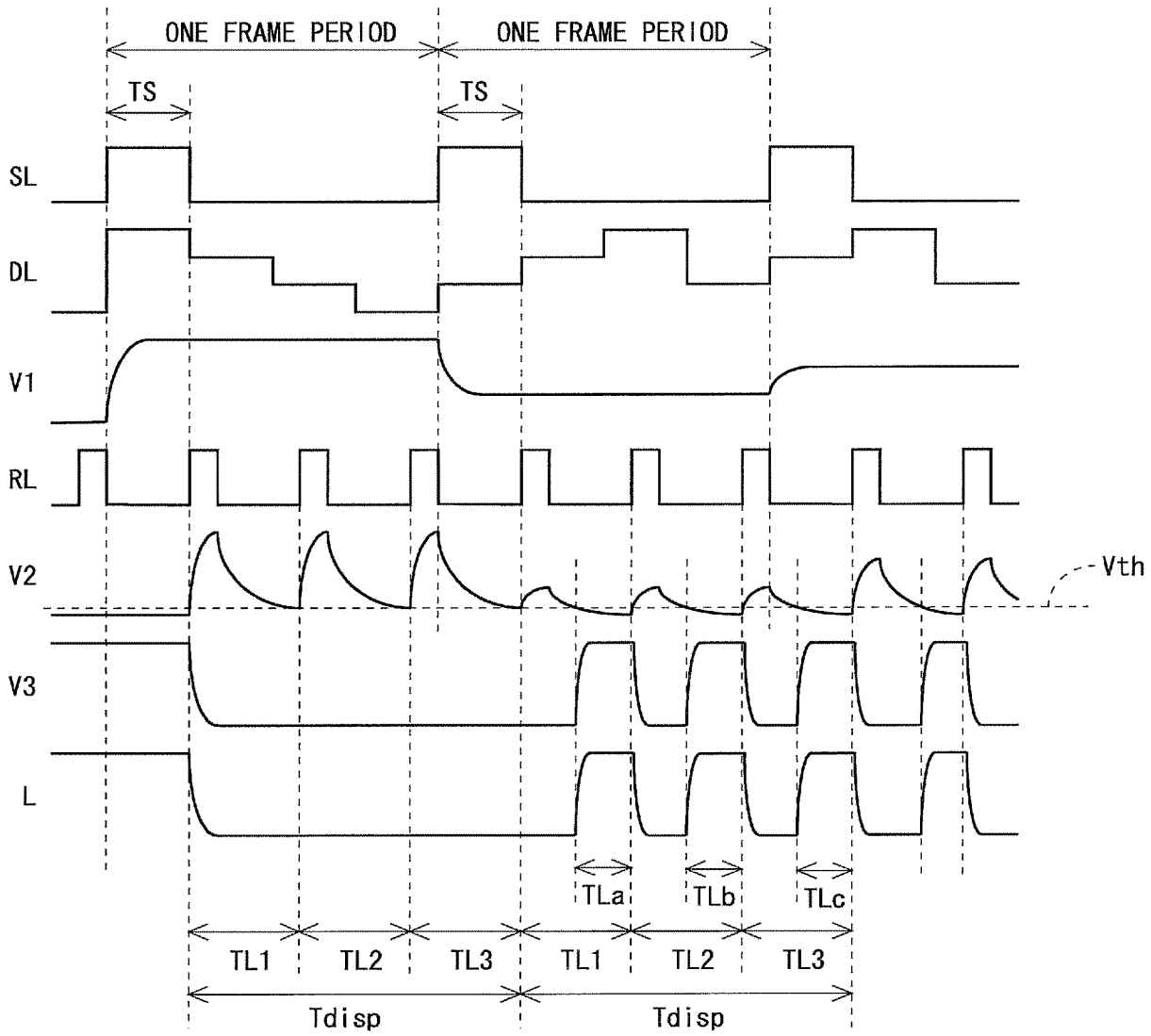
FIG. 6 is a signal waveform chart for explaining an operation of the backlight according to the first embodiment.

Next, an operation of the backlight 40 will be described with reference to FIG. 6. Here, a focus is given to one of the areas. As can be seen from FIG. 6, regarding each of the LED drive circuits 400, a charge period TS of a predetermined length is provided every one frame period. Then, during a period of a length corresponding to a length of one frame period from a time point at which the charge period TS ends, three lighting enable periods TL1-TL3 are provided. Specifically, a display period Tdisp of a length corresponding to the length of one frame period is provided. It should be noted that the number of the lighting enable periods provided after the charge period TS is not limited to 3.

During the charge period TS, the potential of the scanning signal SL becomes high level. With this, the selection control transistor 402 is turned to the ON state. As a result, the data voltage (the voltage of the data signal DL) is written to the memory capacitor 404, and a potential V1 of the data voltage holding node N1 changes depending on a magnitude of the data voltage. It should be noted that the data voltage takes a value corresponding to target brightness of the LEDs included in the corresponding LED unit 490.

Upon completion of the charge period TS, the potential of the scanning signal SL becomes low level. With this, the selection control transistor 402 is turned to the OFF state, and the data line DL and the data voltage holding node N1 are electrically disconnected. Therefore, the potential V1 at the data voltage holding node N1 is maintained until the charge period TS starts next.

Immediately after each of the lighting enable periods TL1-TL3, the reset signal RL becomes high level. With this, the reset control transistor 408 is turned to the ON state. Since the voltage follower circuit 406 is provided between the data voltage holding node N1 and the reset control transistor 408 as shown in FIG. 1, the potential V1 at the data voltage holding node N1 is supplied to the lighting control node N2 as it is. In this manner, the voltage follower circuit 406 serves as a buffer circuit. As a result, a potential V2 at the lighting control node N2 becomes equals to the potential V1 at the data voltage holding node N1. Here, as the configuration in which the voltage follower circuit 406 and the reset control transistor 408 are provided between the data voltage holding node N1 and the lighting control node N2 is employed, it is sufficient to write the data voltage to the memory capacitor 404 only once for one frame period.

Thereafter, when the reset signal RL becomes low level, the reset control transistor 408 is turned to the OFF state, and supply of an electric charge from the data voltage holding node N1 to the lighting control node N2 stops. With this, the potential V2 at the lighting control node N2 decreases depending on a time constant of the RC circuit constituted by the lighting control capacitor 410 and the lighting control resistor 412. It should be noted that, as long as the potential V2 at the lighting control node N2 decreases over time in this manner, a different circuit may be used in place of the RC circuit.

When the potential V2 at the lighting control node N2 is equal to or higher than a potential corresponding to a threshold voltage Vth of the switch control transistor 416 (typically, about 0.6 V), a potential V3 at the drive current control node N3 is relatively low as a collector current flows. At this time, the driving transistor 420 is maintained to be the OFF state, and a current (drive current) does not flow through the LEDs constituting the LED unit 490. Therefore, the LEDs are maintained in an unlit state. In FIG. 6, a light emission intensity of the LEDs constituting the LED unit 490 is represented by a reference sign L.

When the potential V2 at the lighting control node N2 is lower than the potential corresponding to the threshold voltage Vth of the switch control transistor 416, the potential V3 at the drive current control node N3 is relatively high as no collector current flows. At this time, the driving transistor 420 is in the ON state, and a current (drive current) flows through the LEDs constituting the LED unit 490. Therefore, the LEDs are in a lit state.

In the meantime, in a case in which the potential V2 at the lighting control node N2 increases up to an extremely high level after the lighting enable period starts, the potential V2 at the lighting control node N2 is maintained at a potential equal to or higher the threshold voltage Vth throughout the lighting enable period. Therefore, during the lighting enable period, the LEDs are maintained in the unlit state.

On the other hand, in a case in which the potential V2 at the lighting control node N2 increases only up to a level that is below a certain level after the lighting enable period starts, the potential V2 at the lighting control node N2 decreases to be lower than the potential corresponding to the threshold voltage Vth at a certain point in the lighting enable period. With this, from a time point at which the potential V2 at the lighting control node N2 becomes lower than the potential corresponding to the threshold voltage Vth to a time point at which the lighting enable period ends (periods represented by reference signs TLa, TLb, and TLc in FIG. 6), the LEDs are in the lit state.

Figure 7:
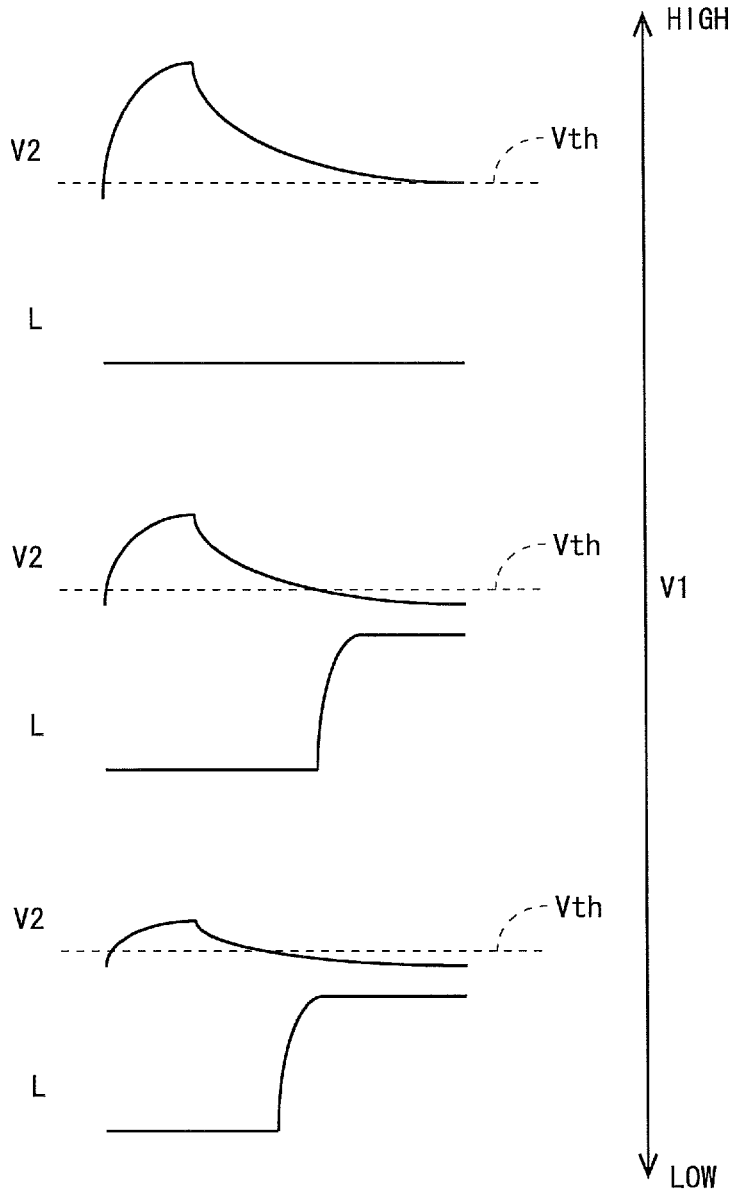
FIG. 7 is a chart for illustrating relationship between a potential at a data voltage holding node and a length of a lighting period of a LED according to the first embodiment.

From the above, as shown in FIG. 7, the higher the potential V1 at the data voltage holding node N1 (the data voltage held in the memory capacitor 404) is, the shorter the lighting period of the LEDs is because the period in which the potential V2 at the lighting control node N2 is maintained to be equal to or higher than the potential corresponding to the threshold voltage Vth becomes longer, and the lower the potential V1 at the data voltage holding node N1 is, the longer the lighting period of the LEDs is because the potential V2 at the lighting control node N2 becomes lower than the potential corresponding to the threshold voltage Vth at earlier timing. In this manner, the brightness of the LEDs is controlled by controlling the length of the lighting period of the LEDs. It should be noted that an operation in which the LEDs are lit for a period of a length depending on the data voltage held in the memory capacitor 404 corresponds to a lighting period control operation.

The data voltage is written to the memory capacitor 404 once for each frame period. Further, the voltage follower circuit 406 is provided between the data voltage holding node N1 and the reset control transistor 408. Therefore, the potential V1 at the data voltage holding node N1 is maintained for a period substantially corresponding to a length of one frame period. Accordingly, the operation for supplying an electric charge from the data voltage holding node N1 to the lighting control node N2 by tuning the reset control transistor 408 to the ON state can be repeated more than once during one frame period. In this embodiment, this operation is repeated three times in one frame period. Specifically, as described above, during a period of a length corresponding to a length of one frame period from the time point at which the charge period TS ends, three lighting enable periods TL1-TL3 are provided (see FIG. 6).

By providing a plurality of lighting enable periods in one frame period in this manner, a lighting cycle of the LEDs becomes shorter than ½ of the display cycle. This prevents flicker from occurring.

In the meantime, the operation of the LED drive circuit 400 is controlled by the light source drive circuit 42. Specifically, the operation of each of the LED drive circuits 400 is controlled by the light source drive circuit 42, so that the data voltage corresponding to target brightness of the one or more LEDs included in the corresponding LED unit 490 is written to the memory capacitor 404 during the charge period TS, and so that the above lighting period control operation is performed more than once for each frame period.

It should be noted that a value of the data voltage is set to be lower than a value of the power-supply voltage, the potential of the scanning signal SL and the reset signal RL on the high level side is set to be a potential higher than a potential of the power-supply voltage by several volts, and the potential of the scanning signal SL and the reset signal RL on the low level side is set to be a potential lower than a ground potential GND. The higher the potential of the scanning signal SL and the reset signal RL on the high level side is set, the shorter the charge period TS can be.

<1.3 Effect>

According to this embodiment, one or more LEDs that constitute each of the LED units 490 in the backlight 40 are driven by active matrix-type driving. Specifically, the data lines DL for supplying the data voltage to the LEDs are provided for respective columns, and the scanning lines SL are provided for respective rows in order to perform driving row by row. Therefore, there is no possibility that the number of lines for driving the LEDs becomes enormous. Further, an entire part of one frame period is taken as the display period. Moreover, the LED drive circuit 400 turns on the LEDs for a period of a length depending on the data voltage held in the memory capacitor 404. Specifically, brightness of the LEDs is controlled by the PWM dimming control. Therefore, it is possible to reduce occurrence of display defects such as variation in brightness. Furthermore, the operation of turning on the LEDs by the LED drive circuit 400 is performed more than once (3 times in the above example) for each frame period. This makes the lighting cycle of the LEDs shorter, and prevents flicker from occurring. As described above, according to this embodiment, it is possible to realize a liquid crystal display device having the backlight (light emitting device) 40 capable of controlling a large number of LEDs independently without causing display defects such as variation in brightness and flicker.

2. Second Embodiments

<2.1 Outline>

In a case in which microscopic LEDs such as mini LEDs and micro LEDs are employed for the light source of the backlight, a size of am area as a driving unit for local dimming becomes extremely small. In this case, regarding the LED substrate, it is often difficult to secure region for placing the components such as field-effect transistors (FETs) that constitute the LED drive circuit 400 described above. Therefore, as the second embodiment, an example in which the LED drive circuit 400 and lines such as the scanning lines SL and the like are stacked on the LED substrate will be described.

As a material of the LED substrate, glass or plastic may be employed. The LED drive circuit 400 and lines such as the scanning lines SL and the like are stacked on the LED substrate. On one surface facing the liquid crystal panel 30 out of surfaces of such a LED substrate, the LEDs are mounted by chip bonding.

It should be noted that an overall configuration and a schematic configuration of the backlight are the same as in the first embodiment, and therefore description for these configurations are omitted (see FIG. 2 to FIG. 4). However, it is assumed that there are a large number of minute areas.

<2.2 Configuration and Operation of LED Drive Circuit>

Figure 8:
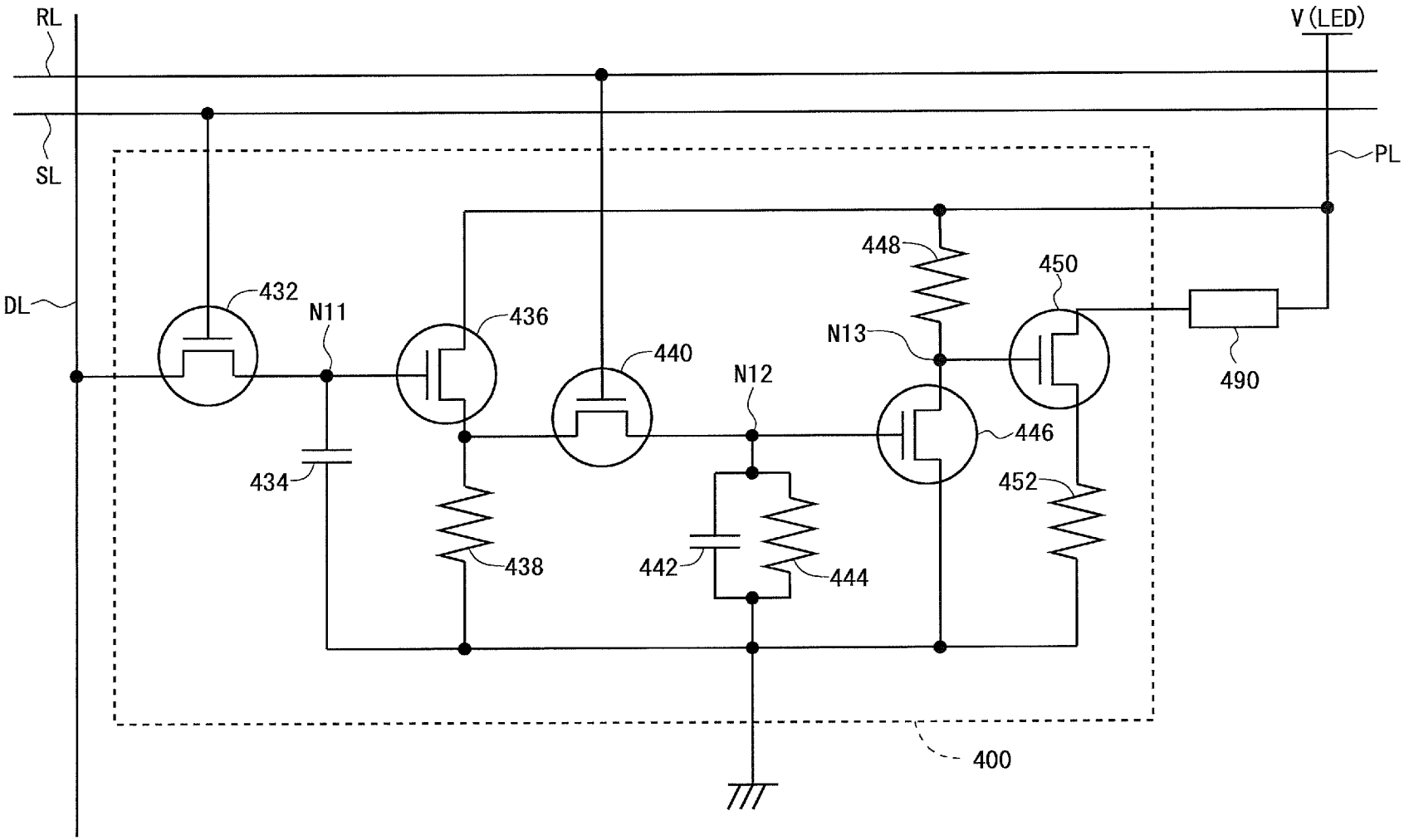
FIG. 8 is a circuit diagram showing a detailed configuration of a LED drive circuit according to a second embodiment.

FIG. 8 is a circuit diagram showing a detailed configuration of the LED drive circuit 400 according to this embodiment. As shown in FIG. 8, the LED drive circuit 400 is configured by a selection control transistor 432 which is a thin film transistor (TFT), a memory capacitor 434 which is a capacitor for holding a data voltage (voltage of the data signal DL), a thin film transistor (hereinafter referred to as a "buffer-construction transistor") 436 and a resistor (hereinafter referred to as a "buffer-construction resistor") 438 that constitute a source follower circuit, a reset control transistor 440 which is a thin film transistor, a lighting control capacitor 442 and a lighting control resistor 444 that constitute an RC circuit, a switch control transistor 446 which is a thin film transistor, a pull-up resistor 448, a driving transistor 450 which is a thin film transistor, and a voltage drop resistor 452. As can be seen from FIG. 8, the LED unit 490 is disposed between the power line PL and a drain terminal of the driving transistor 450.

Thin film transistors are used in this embodiment instead of field-effect transistors because it is not possible to employ high-temperature treatment in order to cause layers to be stacked. Therefore, amorphous silicon TFTs, low-temperature polysilicon TFTs, and oxide semiconductor TFTs such as IGZO are typically used.

Hereinafter, a relationship of connection between the components will be described. In this embodiment, a node connected to the selection control transistor 432, the memory capacitor 434, and the buffer-construction transistor 436 is referred to as a "data voltage holding node", a node connected to the reset control transistor 440, the lighting control capacitor 442, the lighting control resistor 444, and the switch control transistor 446 is referred to as a "lighting control node", and a node connected to the switch control transistor 446, the pull-up resistor 448, and the driving transistor 450 is referred to as a "drive current control node". The data voltage holding node is represented by a reference sign N11, the lighting control node is represented by a reference sign N12, and the drive current control node is represented by a reference sign N13.

Regarding the selection control transistor 432, its gate terminal is connected to the scanning line SL, its drain terminal is connected to the data line DL, and its source terminal is connected to the data voltage holding node N11. Regarding the memory capacitor 434, one end is connected to the data voltage holding node N11 and the other end is grounded. Regarding the buffer-construction transistor 436, its gate terminal is connected to the data voltage holding node N11, its drain terminal is connected to the power line PL, and its source terminal is connected to one end of the buffer-construction resistor 438 and a drain terminal of the reset control transistor 440. Regarding the buffer-construction resistor 438, one end is connected to the source terminal of the buffer-construction transistor 436 and the drain terminal of the reset control transistor 440, and the other end is grounded.

Regarding the reset control transistor 440, its gate terminal is connected to the reset line RL, its drain terminal is connected to the source terminal of the buffer-construction transistor 436 and the one end of the buffer-construction resistor 438, and its source terminal is connected to the lighting control node N12. Regarding the lighting control capacitor 442, one end is connected to the lighting control node N12 and the other end is grounded. Regarding the lighting control resistor 444, one end is connected to the lighting control node N12 and the other end is grounded.

Regarding the switch control transistor 446, its gate terminal is connected to the lighting control node N12, its drain terminal is connected to the drive current control node N13, and its source terminal is grounded. Regarding the pull-up resistor 448, one end is connected to the power line PL, and the other end is connected to the drive current control node N13. Regarding the driving transistor 450, its gate terminal is connected to the drive current control node N13, its drain terminal is connected to the LED unit 490, and its source terminal is connected to one end of the voltage drop resistor 452. Regarding the voltage drop resistor 452, the one end is connected to the source terminal of the driving transistor 450 and the other end is grounded.

It should be noted that, in this embodiment, the selection control transistor 432, the data voltage holding node N11, and the memory capacitor 434 realize the data voltage holding unit. The reset control transistor 440, the lighting control node N12, the lighting control capacitor 442, the lighting control resistor 444, the switch control transistor 446, the drive current control node N13, the pull-up resistor 448, the driving transistor 450, and the voltage drop resistor 452 realize the lighting control unit. The reset control transistor 440 realizes the reset unit. The RC circuit constituted by the lighting control capacitor 442 and the lighting control resistor 444 realize the potential reduction unit. The switch control transistor 446, the drive current control node N13, the pull-up resistor 448, the driving transistor 450, and the voltage drop resistor 452 realize the drive current control unit.

In the above configuration, an operation that is the same as in the first embodiment is performed. However, while the potential at the data voltage holding node N1 is supplied to the lighting control node N2 as it is in the first embodiment, a potential lower than the potential at the data voltage holding node N11 by a threshold voltage of the buffer-construction transistor 436 is supplied to the lighting control node N12 as the source follower circuit is used as a buffer circuit in this embodiment. Therefore, it is necessary to supply the data line DL with the data signal DL considering voltage drop between the data voltage holding node N11 and the lighting control node N12.

<2.3 Effect>

According to this embodiment, even in a case in which the LED substrate is logically divided into an extremely large number of areas, it is possible to control the LEDs independently without causing display defects such as variation in brightness and flicker.

3. Third Embodiment

<3.1 Overall Configuration>

Figure 9:
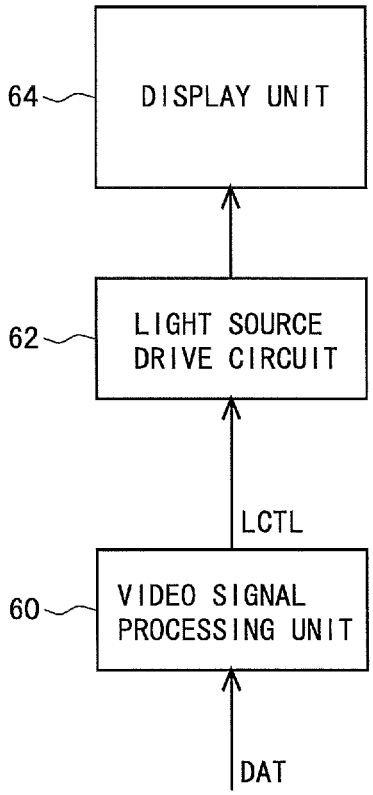
FIG. 9 is a block diagram showing an entire configuration of a LED display device according to a third embodiment.

FIG. 9 is a block diagram showing an entire configuration of a LED display device according to the third embodiment. The LED display device is a display device using LEDs as pixels. As shown in FIG. 9, the LED display device is configured by a video signal processing unit 60, a light source drive circuit 62, and a display unit 64. It should be noted that the display unit 64 in this embodiment corresponds to the illumination unit 44 in the first embodiment (see FIG. 2). Specifically, the display unit 64 is constituted by the LED units and the LED drive circuits which are provided on the substrate (LED substrate). The video signal processing unit 60 and the light source drive circuit 62 are typically disposed on different substrates.

The video signal processing unit 60 receives the image data DAT transmitted from outside, and outputs the brightness control signal LCTL for controlling an operation of the light source drive circuit 62. Here, the brightness control signal LCTL are constituted by a plurality of control signals. The light source drive circuit 62 controls an operation of the LED drive circuits, based on the brightness control signal LCTL transmitted from the video signal processing unit 60, so that the LEDs in the display unit 64 emit light with desired brightness. The display unit 64 includes the LED units and the LED drive circuits as described above, and the one or more LEDs in the LED unit emit light with desired brightness by the light source drive circuit 62 controlling the operation of the LED drive circuits.

In the meantime, in this embodiment, the plurality of LED units provided in the display unit 64 are classified into three types. More specifically, the plurality of LED units are classified into a red LED unit including one or more red LEDs emitting red light, a green LED unit including one or more green LEDs emitting green light, and a blue LED unit including one or more blue LEDs emitting blue light. Further, the plurality of LED units are arranged so that the red LED unit, the green LED unit, and the blue LED unit constitute a single picture element. Therefore, an image is displayed on the display unit 64 by the LEDs in the plurality of LED units emitting light with desired brightness.

It should be noted that although the example in which LED units of three different colors constitute a single picture element is described, a single picture element may be constituted by LED units of 4 or more different colors.

<3.2 Configuration of Display Unit>

Figure 10:
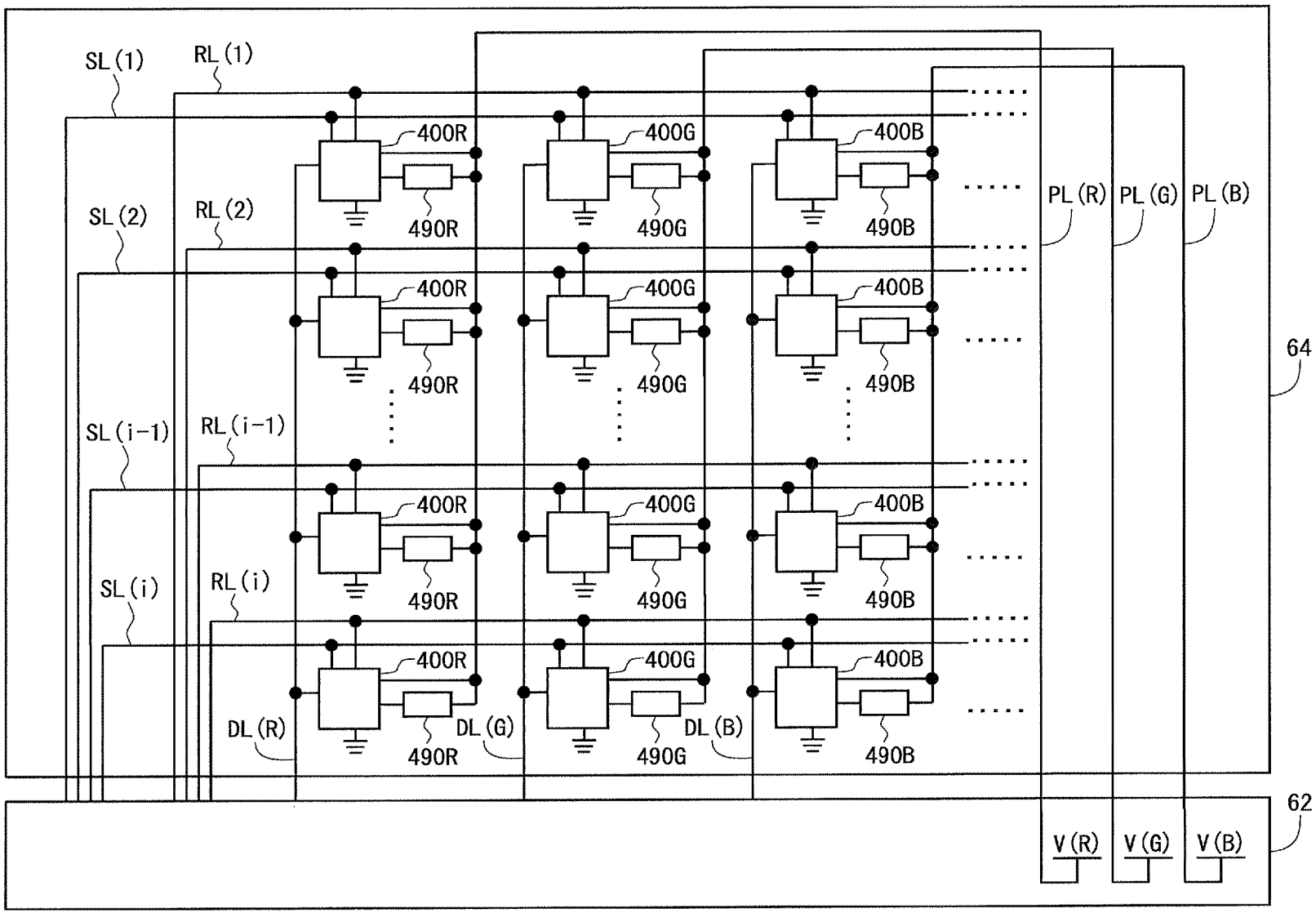
FIG. 10 is a block diagram for illustrating a schematic configuration of a display unit according to the third embodiment.
Figure 11:
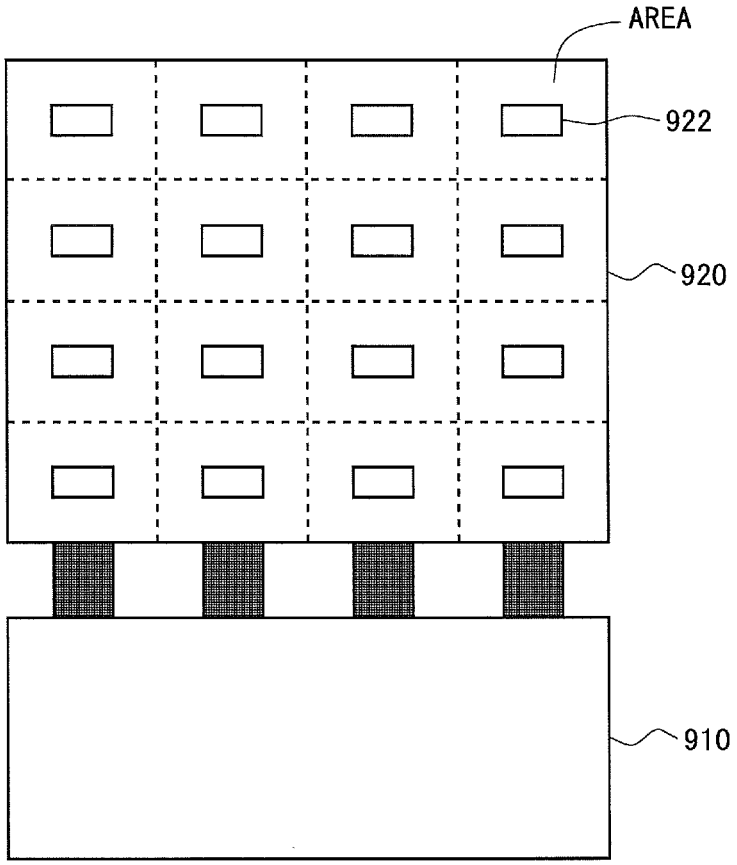
FIG. 11 is a schematic view of a direct backlight employing the local dimming, relating to the conventional example.
Figure 12:
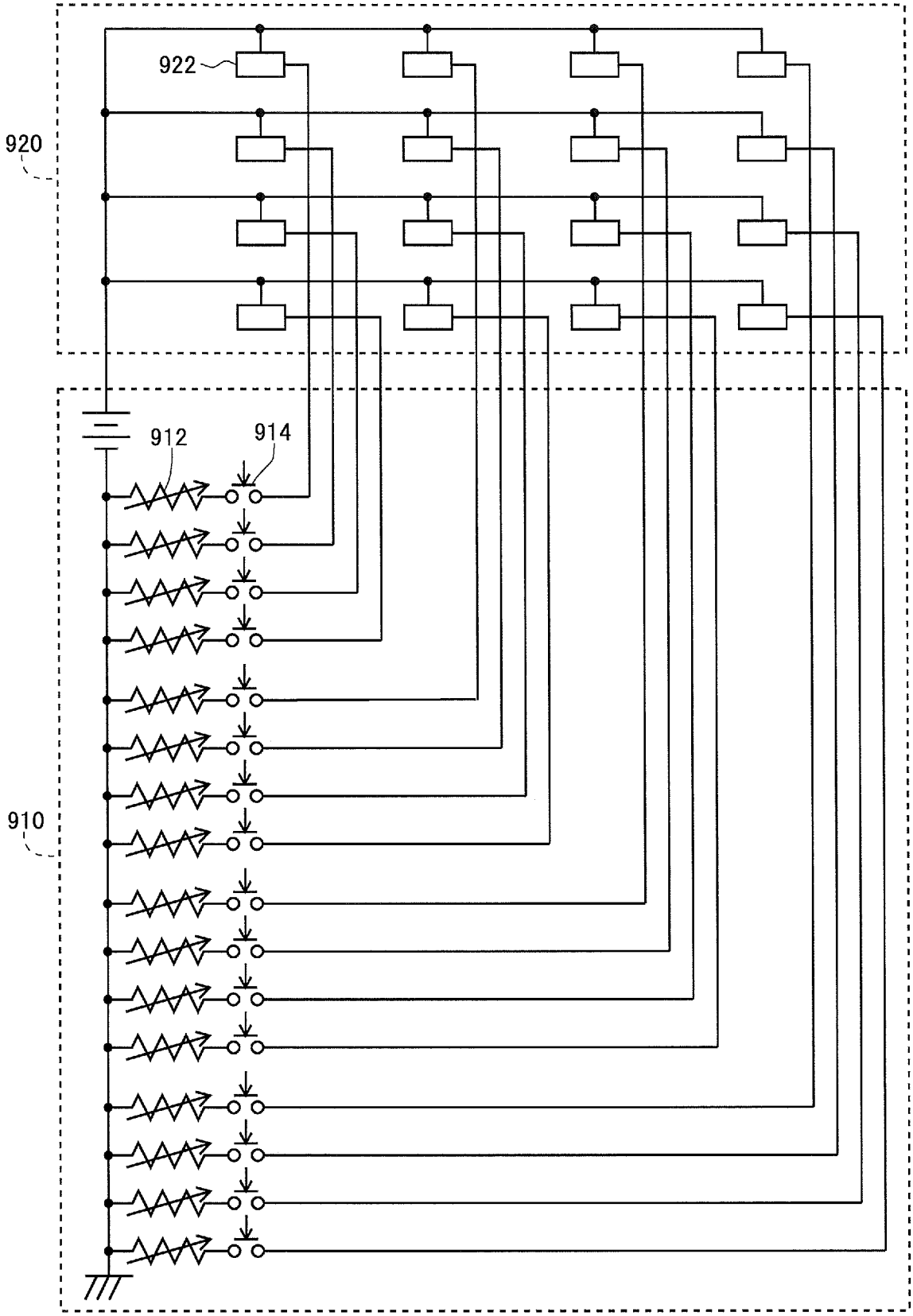
FIG. 12 is a diagram schematically showing wiring conditions of a LED driver substrate and a LED substrate, relating to the conventional example (a case in which LEDs are driven individually).
Figure 13:
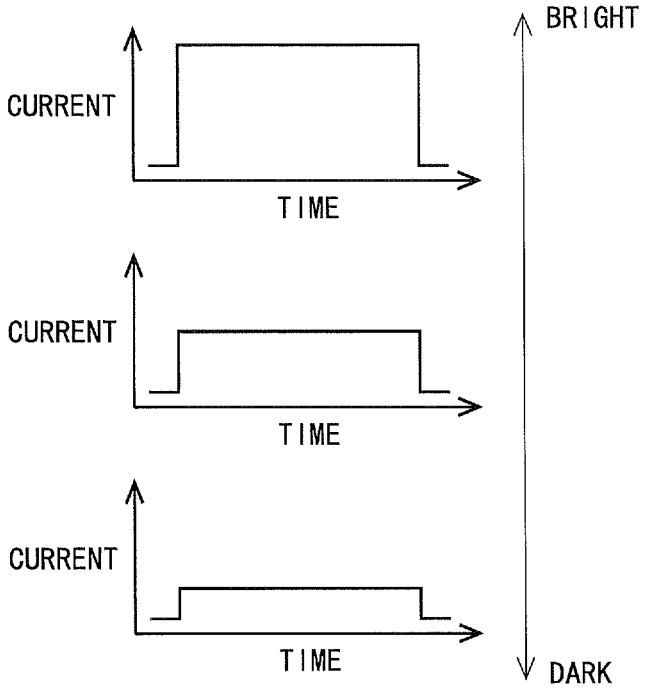
FIG. 13 is a chart for illustrating an analog dimming control method, relating to the conventional example.
Figure 14:
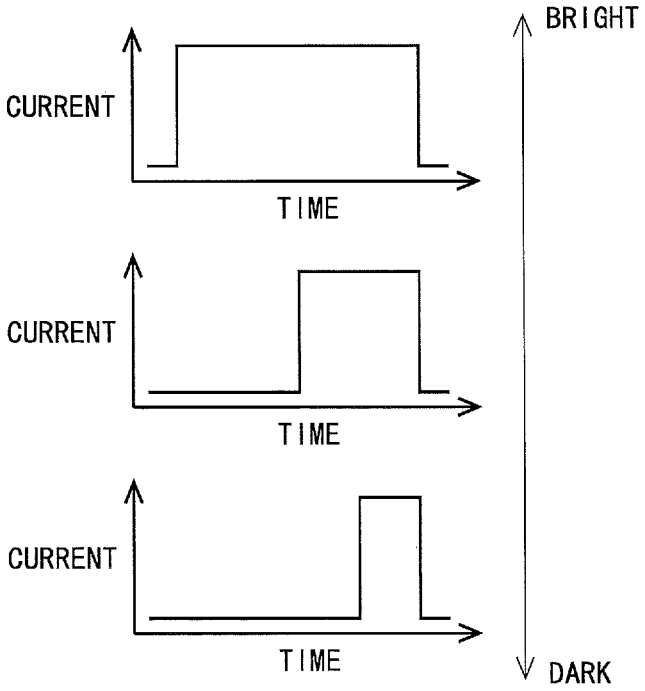
FIG. 14 is a chart for illustrating a PWM dimming control method, relating to the conventional example.
Figure 15:
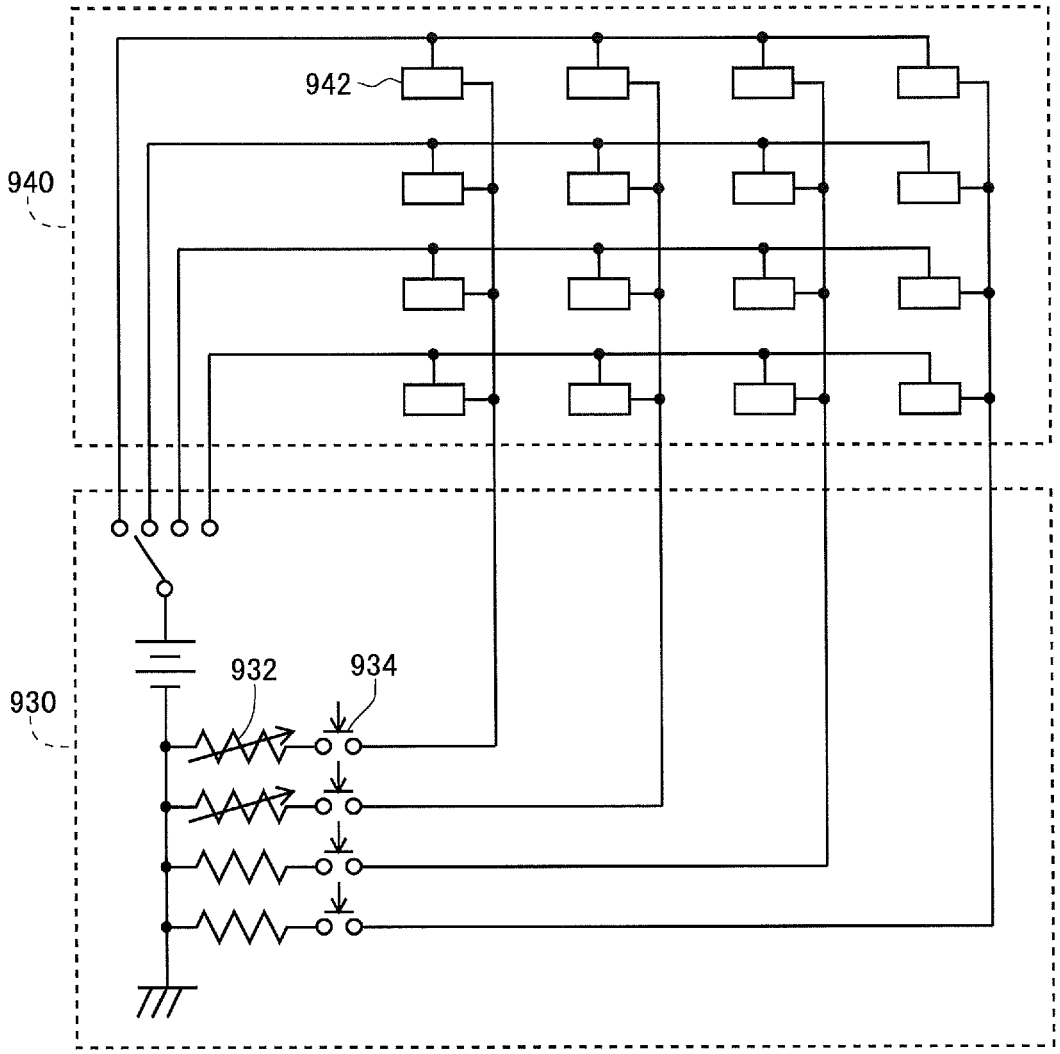
FIG. 15 is a diagram schematically showing wiring conditions of a LED driver substrate and a LED substrate, relating to the conventional example (a case in which passive driving is performed).
Figure 16:
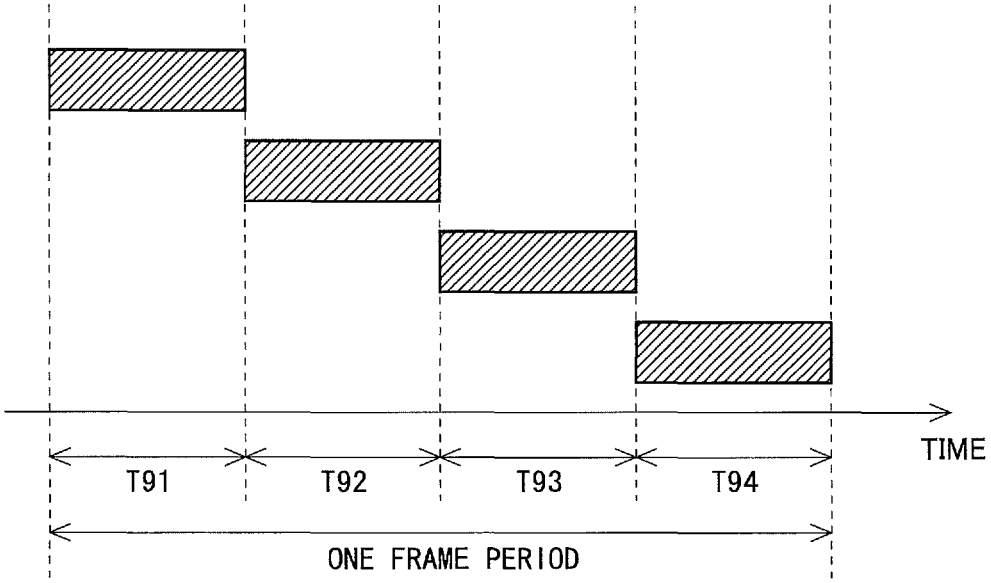
FIG. 16 is a diagram for illustrating one frame period when passive driving is performed, relating to the conventional example.
Figure 17:
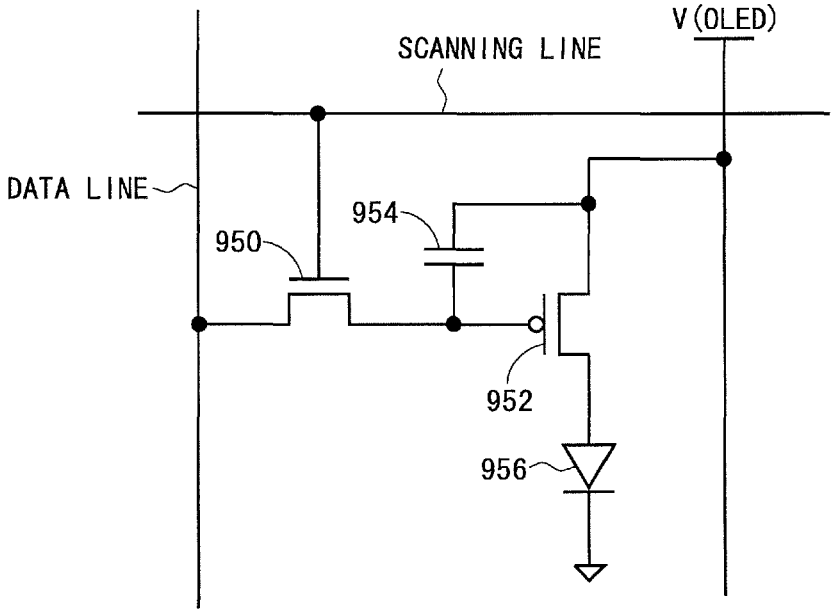
FIG. 17 is a circuit diagram showing one example of a pixel circuit of an organic EL display device, relating to the conventional example.
Figure 18:
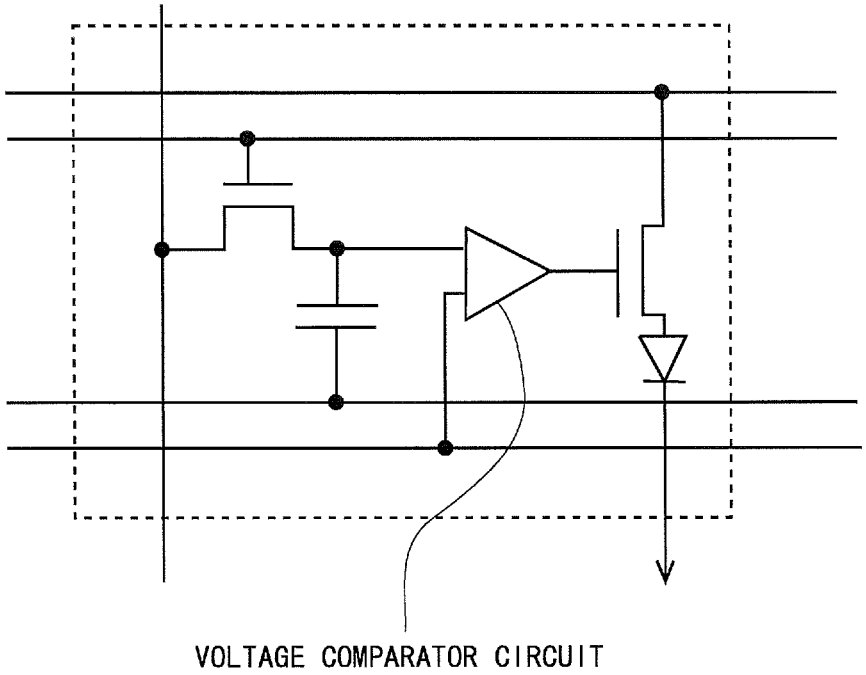
FIG. 18 shows a diagram corresponding to FIG. 1 of Japanese Laid-Open Patent Publication No. 2002-297097, relating to the conventional example.
Figure 19:
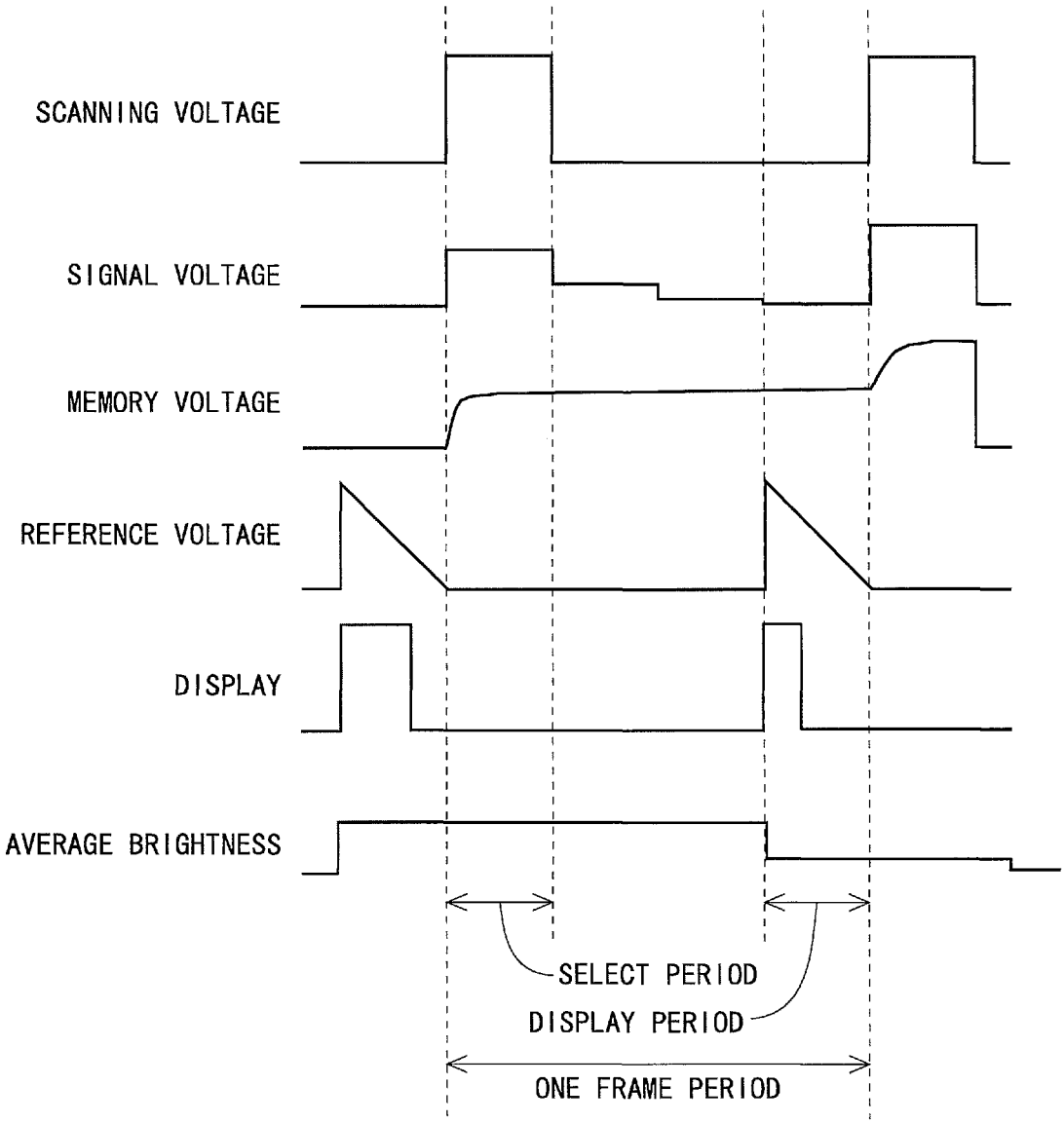
FIG. 19 shows a chart corresponding to FIG. 2 of Japanese Laid-Open Patent Publication No. 2002-297097, relating to the conventional example.
Figure 20:
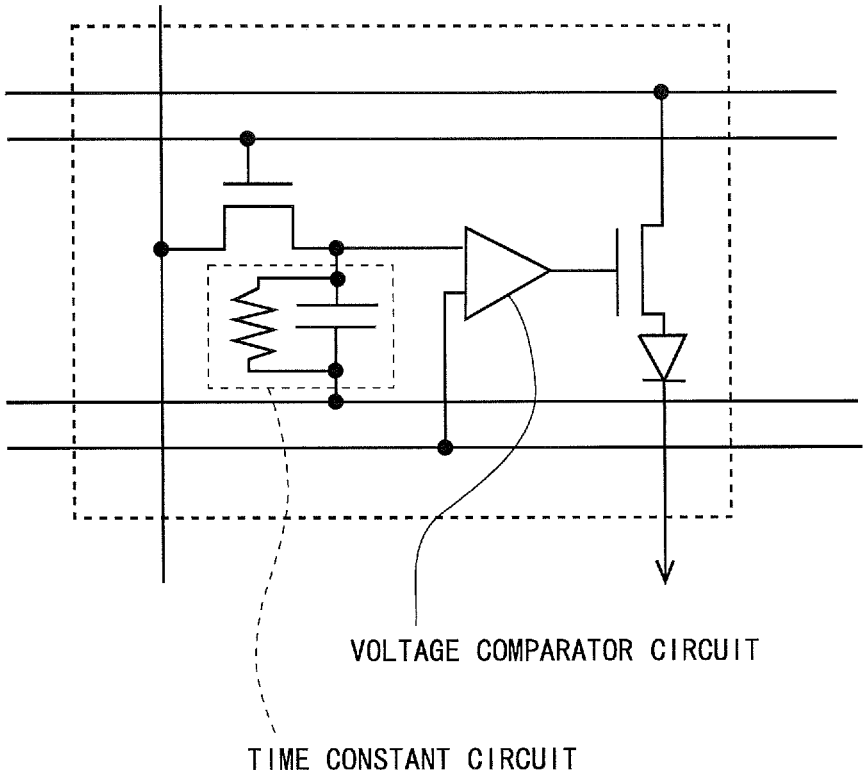
FIG. 20 shows a diagram corresponding to FIG. 3 of Japanese Laid-Open Patent Publication No. 2002-297097, relating to the conventional example.
Figure 21:
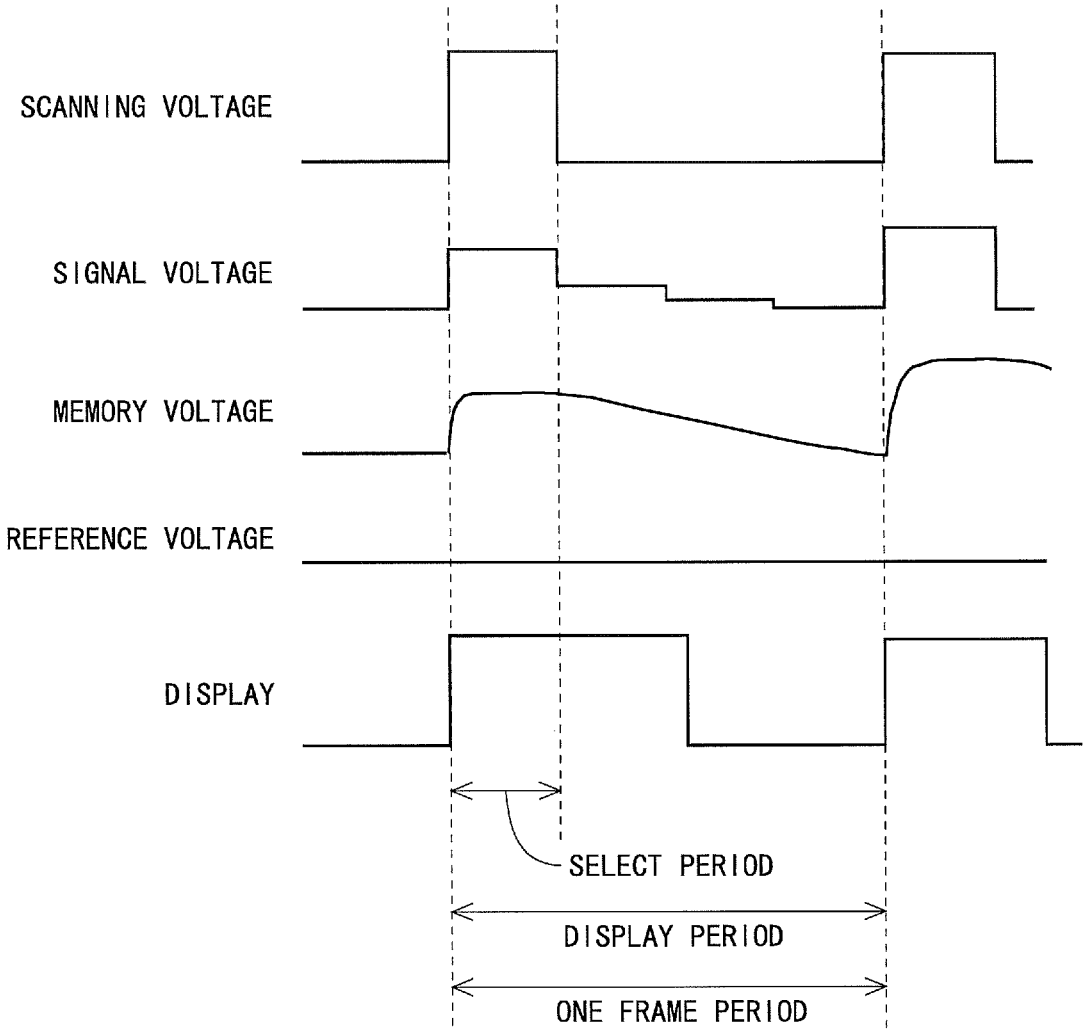
FIG. 21 shows a chart corresponding to FIG. 4 of Japanese Laid-Open Patent Publication No. 2002-297097, relating to the conventional example.

FIG. 10 is a block diagram for illustrating a schematic: configuration of the display unit 64. The display unit 64 includes LED units each constituted by one or more LEDs and LED drive circuits for driving LEDs included in the LED units. Here, a red LED unit is represented by a reference sign 490R, a green LED unit is represented by a reference sign 490G, and a blue LED unit is represented by a reference sign 490B. Further, a LED drive circuit corresponding to the red LED unit 490R is represented by a reference sign 400R, a LED drive circuit corresponding to the green LED unit 490G is represented by a reference sign 400G, and a LED drive circuit corresponding to the blue LED unit 490B is represented by a reference sign 400B. A set of "the red LED unit 490R, the green LED unit 490G, and the blue LED unit 490B" constitute a single picture element, and picture elements each being configured in such a manner are arranged in matrix on the display unit 64.

Regarding the power line, the red power line PL(R) for supplying a red power-supply voltage V(R) for driving the red LEDs to the red LED unit 490R, the green power line PL(G) for supplying a green power-supply voltage V(G) for driving the green LEDs to the green LED unit 490G, and the blue power line PL(B) for supplying a blue power-supply voltage V(B) for driving the blue LEDs to the blue LED unit 490B are disposed on the LED substrate. The power lines are provided for the respective colors because a forward voltage drop Vf of the LEDs is different for each color. Further, similarly to the first embodiment, the scanning lines SL provided for respective rows, the reset lines RL provided for respective rows, and the data lines DL provided for respective columns are disposed on the LED substrate. It should be noted that in the example shown in FIG. 10, the number of scanning lines and the number of reset lines are i.

<3.3 Configuration and Operation of LED Drive Circuit>

As the configuration of the LED drive circuits 400R, 400G, and 400B, a configuration similar to that of the LED drive circuit 400 in the first embodiment or the second embodiment is employed. This also applies to operations of the LED drive circuits 400R, 400G, and 400B. However, in this embodiment, the red LED unit 490R serves as a pixel for red color, the green LED unit 490G serves as a pixel for: green color, and the blue LED unit 490B serves as a pixel for blue color. Therefore, a data voltage corresponding to a pixel value for the red pixel is supplied to the data line DL(R), a data voltage corresponding to a pixel value for the green pixel is supplied to the data line DL(G), and a data voltage corresponding to a pixel value for the blue pixel is supplied to the data line DL(B). With this, an image is displayed on the display unit 64 by LEDs of the respective colors emitting light with desired brightness.

<3.3 Effect>

According to this embodiment, it is possible to realize a LED display device capable of controlling a large number of LEDs (LEDs serving as pixels) independently without causing display defects such as variation in brightness and flicker.

While the present invention has been described in detail, the description herein is considered as exemplary in every respect, and not restrictive. It is understood that a variety of modifications and variations can be made without departing from the scope of the present invention.

What is claimed is:

1. A light emitting device with LEDs as light sources, the light emitting device comprising:

a plurality of LED units arranged in matrix, each of the plurality of LED units including one or more LEDs;

a plurality of LED drive circuits configured to drive LEDs included in the plurality of LED units, the plurality of LED drive circuits corresponding to the plurality of LED units one on one;

a drive control circuit configured to control an operation of the plurality of LED drive circuits so that the LEDs included in the plurality of LED units are driven row by row, wherein each of the LED drive circuits includes:

a data voltage holding unit configured to hold a data voltage corresponding to target brightness of one or more LEDs included in a corresponding LED unit; and a lighting control unit configured to perform a lighting period control operation in which the one or more LEDs included in the corresponding LED unit is lit for a period of a length depending on the data voltage held in the data voltage holding unit, a signal line for supplying the data voltage to the plurality of LED drive circuits is provided for each column, regarding each of plurality of the LED drive circuits, a charge period of a predetermined length is provided every one frame period, and a plurality of lighting enable periods are provided during a period of a length corresponding to a length of one frame period from a time point at which the charge period ends, and an operation of each of the plurality of LED drive circuits is controlled by the drive control circuit, so that the data voltage corresponding to target brightness of the one or more LEDs included in the corresponding LED unit is written to the data voltage holding unit during the charge period, and so that the lighting period control operation by the lighting control unit is performed in the plurality of lighting enable periods.

2. The light emitting device according to claim 1, wherein the lighting control unit includes:

a lighting control node;

a reset unit configured to control supply of a voltage corresponding to the data voltage held in the data voltage holding unit to the lighting control node;

a potential reduction unit configured to cause a potential at the lighting control node to decrease over time; and a drive current control unit configured to control supply of a drive current to a corresponding LED unit depending on a potential at the lighting control node.

3. The light emitting device according to claim 2, wherein the potential reduction unit is an RC circuit including a lighting control capacitor and a lighting control resistor, the lighting control capacitor having one end connected to the lighting control node, the lighting control resistor having one end connected to the lighting control node and another end connected to another end of the lighting control capacitor.

4. The light emitting device according to claim 2, wherein the drive current control unit includes:

a drive current control node;

a switch control resistor having one end connected to the lighting control node;

a switch control transistor which is a bipolar transistor having a base terminal connected to another end of the switch control resistor, a collector terminal connected to the drive current control node, and an emitter terminal that is grounded;

a pull-up resistor having one end to which a power-supply voltage is supplied, and another end connected to the drive current control node;

a driving transistor which is a field-effect transistor having a gate terminal connected to the drive current control node, and a drain terminal to which the power-supply voltage is supplied via a corresponding LED unit; and a voltage drop resistor having one end connected to a source terminal of the driving transistor, and another end that is grounded.

5. The light emitting device according to claim 2, wherein the drive current control unit includes:

a drive current control node;

a switch control transistor which is a thin film transistor having a gate terminal connected to the lighting control node, a drain terminal connected to the drive current control node, and a source terminal that is grounded;

a pull-up resistor having one end to which a power-supply voltage is supplied, and another end connected to the drive current control node;

a driving transistor which is a thin film transistor having a gate terminal connected to the drive current control node, and a drain terminal to which the power-supply voltage is supplied via a corresponding LED unit; and a voltage drop resistor having one end connected to a source terminal of the driving transistor, and another end that is grounded.

6. The light emitting device according to claim 1, wherein each of the plurality of LED drive circuits includes a buffer circuit configured to supply the lighting control unit with a potential corresponding to the data voltage held in the data voltage holding unit.

7. The light emitting device according to claim 1, further comprising:

data lines configured to transmit data signals outputted from the drive control circuit, the data lines being arranged so as to correspond to respective columns;

scanning lines configured to transmit scanning signals outputted from the drive control circuit, the scanning lines being arranged so as to correspond to respective rows; and reset lines configured to transmit reset signals outputted from the drive control circuit, the reset lines being arranged so as to correspond to respective rows, wherein the data voltage holding unit includes:

a data voltage holding node;

a selection control transistor including a first selection control transistor and a second selection control transistor, the first selection control transistor being a field-effect transistor having a gate terminal connected to a corresponding one of the scanning lines and a drain terminal connected to a corresponding one of the data lines, the second selection control transistor being a field-effect transistor having a gate terminal connected to the corresponding one of the scanning lines, a drain terminal connected to the data voltage holding node, and a source terminal connected to a source terminal of the first selection control transistor; and a memory capacitor having one end connected to the data voltage holding node, and another end that is grounded, each of the plurality of LED drive circuits includes a voltage follower circuit configured to supply the lighting control unit with a potential at the data voltage holding node, the lighting control unit includes:

a lighting control node;

a drive current control node;

a reset control transistor including a first reset control transistor and a second reset control transistor, the first reset control transistor being a field-effect transistor having a gate terminal connected to a corresponding one of the reset lines, a drain terminal connected to an output terminal of the voltage follower circuit, the second reset control transistor having a gate terminal connected to the corresponding one of the reset lines, a drain terminal connected to the lighting control node, and a source terminal connected to a source terminal of the first reset control transistor;

an RC circuit including a lighting control capacitor and a lighting control resistor, the lighting control capacitor having one end connected to the lighting control node and another end that is grounded, the lighting control resistor having one end connected to the lighting control node and another end that is grounded;

a switch control resistor having one end connected to the lighting control node;

a switch control transistor which is a bipolar transistor having a base terminal connected to another end of the switch control resistor, a collector terminal connected to the drive current control node, and an emitter terminal that is grounded;

a pull-up resistor having one end to which a power-supply voltage is supplied, and another end connected to the drive current control node;

a driving transistor which is a field-effect transistor having a gate terminal connected to the drive current control node, and a drain terminal to which the power-supply voltage is supplied via a corresponding LED unit; and a voltage drop resistor having one end connected to a source terminal of the driving transistor, and another end that is grounded.

8. The light emitting device according to claim 1, further comprising:

data lines configured to transmit data signals outputted from the drive control circuit, the data lines being arranged so as to correspond to respective columns;

scanning lines configured to transmit scanning signals outputted from the drive control circuit, the scanning lines being arranged so as to correspond to respective rows; and reset lines configured to transmit reset signals outputted from the drive control circuit, the reset lines being arranged so as to correspond to respective rows, wherein the data voltage holding unit includes:

a data voltage holding node;

a selection control transistor which is a thin film transistor having a gate terminal connected to a corresponding one of the scanning lines, a drain terminal connected to a corresponding one of the data lines, and a source terminal connected to the data voltage holding node; and a memory capacitor having one end connected to the data voltage holding node, and another end that is grounded, each of the plurality of LED drive circuits includes a source follower circuit constituted by a thin film transistor and a resistor, the source follower circuit being configured to supply the lighting control unit with a potential that is lower than a potential at the data voltage holding node by a voltage corresponding to a threshold voltage of the thin film transistor, the lighting control unit includes:

a lighting control node;

a drive current control node;

a reset control transistor which is a thin film transistor having a gate terminal connected to a corresponding one of the reset lines, a drain terminal connected to an output terminal of the source follower circuit, and a source terminal connected to the lighting control node;

an RC circuit including a lighting control capacitor and a lighting control resistor, the lighting control capacitor having one end connected to the lighting control node and another end that is grounded, the lighting control resistor having one end connected to the lighting control node and another end that is grounded;

a switch control transistor which is a thin film transistor having a gate terminal connected to the lighting control node, a drain terminal connected to the drive current control node, and a source terminal that is grounded;

a pull-up resistor having one end to which a power-supply voltage is supplied and another end connected to the drive current control node;

a driving transistor which is a thin film transistor having a gate terminal connected to the drive current control node, and a drain terminal to which the power-supply voltage is supplied via a corresponding LED unit; and a voltage drop resistor having one end connected to a source terminal of the driving transistor, and another end that is grounded.

9. A display device comprising:

a display panel having a display unit for displaying an image; and the light emitting device according to claim 1, the light emitting device disposed on a back surface of the display panel so as to emit light to the display unit.

10. A LED display device comprising:

the light emitting device according to claim 1, wherein the plurality of LED units are classified into K types depending on colors of emitted light, and each of picture elements is configured by LED units of the K types.

* * * * *